US006489727B2

(12) United States Patent
Kanazawa

(10) Patent No.: US 6,489,727 B2
(45) Date of Patent: Dec. 3, 2002

(54) PLASMA DISPLAY WITH IMPROVED DISPLAY CONTRAST

(75) Inventor: Yoshikazu Kanazawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/921,923

(22) Filed: Aug. 6, 2001

(65) Prior Publication Data

US 2002/0047572 A1 Apr. 25, 2002

(30) Foreign Application Priority Data

Aug. 30, 2000 (JP) ..... 2000-261605

(51) Int. Cl.[7] ..... G09G 3/28
(52) U.S. Cl. ..... 315/169.4; 345/60
(58) Field of Search ..... 315/169.3, 169.4; 345/60, 67, 68

(56) References Cited

U.S. PATENT DOCUMENTS 5,877,734 A * 3/1999 Amemiya ..... 315/169.4

FOREIGN PATENT DOCUMENTS

| | | |
|---|---|---|
| JP | 3-219286 | 9/1991 |
| JP | 9-160525 | 6/1997 |

* cited by examiner

*Primary Examiner*—David Vu
(74) *Attorney, Agent, or Firm*—Staas & Halsey LLP

(57) ABSTRACT

A method of driving a plasma display panel includes the steps of detecting, with respect to each cell, whether display data is present, avoiding reset discharge with respect to a cell that is to display a black level because of absence of the display data, and generating reset discharge prior to displaying of the display data with respect to a cell that is to display a non-black level because of presence of the display data.

11 Claims, 25 Drawing Sheets

RESET SUB-FIELD

FIRST SUB-FIELD

SECOND SUB-FIELD

RESET SUB-FIELD

FIRST SUB-FIELD

SECOND SUB-FIELD

RESET DISCHARGE CELL

CELL ADJACENT TO LIGHTING CELL

LIGHTING CELL

PLASMA DISPLAY WITH IMPROVED DISPLAY CONTRAST

BACKGROUND OF THE INVENTION

1. Field of the Invention

The present invention generally relates to plasma display apparatuses, and particularly relates to a plasma display apparatus having an improved display contrast.

2. Description of the Related Art

Plasma display panels have two glass plates on which electrodes are formed, and discharge-purpose gas fills the gap of the order of 100 microns between the two glass plates. Voltages higher than the discharge threshold voltage are applied between the electrodes to start gas discharge, and ultraviolet light generated from the discharge induces the light emission of photo florescent provided on the plate, thereby effecting screen displaying.

FIG. 1 is a diagram showing a schematic configuration of a plasma display apparatus.

A display panel 10 includes first electrodes 14 and second electrodes 15 disposed in parallel, and further includes third electrodes 16 disposed in perpendicular thereto. The first electrodes 14 and the second electrodes 15 are used to provide sustain discharge for display-purpose light emission. Voltage pulses are applied between the first electrodes 14 and the second electrodes 15, thereby carrying out sustain discharge. Either one of the first electrodes 14 and the second electrodes 15 serve as scan-purpose electrodes for writing display data. The third electrodes 16 are used to select display cells 17 that are to emit light. A voltage for writing discharge is applied between the third electrodes 16 and either one of the first electrodes and the second electrodes, so as to select discharge cells. The first electrodes 14, the second electrodes 15, and the third electrodes 16 are connected to a first driving circuit 11, a second driving circuit 12, and a third driving circuit 13, respectively, which serve to generate voltage pulses for specific purposes.

FIG. 2 is a drawing showing details of the display panel unit 10 of the apparatus shown in FIG. 1.

The first electrodes 14 serving as X electrodes and the second electrodes 15 serving as Y electrodes are laid out in parallel. Electrodes for display lines L1 through L4 are only shown in this figure. The third electrodes 16 serving as address electrodes are further formed together with shields 18 for separating the discharge cells. Details of discharge operations will be described later.

FIG. 3 is a drawing showing a frame configuration for explaining driving sequences.

Discharge of a plasma display panel can only assume either one of the "on" state and the "off" state, so that the density, i.e., the gray scale, is represented by the number of repeated light emissions. In order to efficiently implement this, a frame is divided into 10 sub-fields, for example. Each sub-field is comprised of a reset period, an address period, and a sustain discharge period. During the reset period, all cells are equally initialized regardless of lighting status in the previous sub-fields, e.g., are placed in the condition in which wall charge is erased. During the address period, selective discharge (addressing discharge) is performed to select the on/off states of cells in accordance with the display data, thereby generating wall charge that places cells in the "on" state. During the sustain discharge period, discharge is repeated in the cells where addressing discharge was performed, thereby emitting light. The length of the sustain discharge period, i.e., the number of repeated light emissions, differs from sub-field to sub-field. For example, the number of repeated light emissions may be determined such that ratios between sub-fields from the first sub-field to the tenth sub-field are 1:2:4:8: . . . :512. Sub-fields are selected in accordance with the luminance level of the display cell so as to be subjected to gas discharge, thereby achieving a desired gray scale display.

FIG. 4 is a drawing showing the way the reset discharge emits light.

When "black" is displayed in plasma display panels, it is desirable not to have any electrical discharge. Under the conditions where almost no ions, metastable atoms, or the like are present in the cell space, however, addressing discharge may not take place even when the required voltage is applied between the electrodes. In order to avoid this, all cells are periodically subjected to gas discharge.

There are two methods for such periodic discharge. One is to carry out discharge stronger than a predetermined intensity at the time of a start of the first sub-field, as shown in FIG. 4, (a). The other is to carry out small-scale discharge during the reset periods of all the sub-fields, as shown in FIG. 4, (b). These methods can provide a darkroom contrast of about 300:1 to 600:1. To be specific, the brightness of a black portion will be less than 1 cd/$m^2$. Further, these two methods may be combined such that the resetting of a small-scale light emission is performed once in each frame or once in each field. In this case, a darkroom contrast of about 3000:1 is achieved. However, a complete darkness cannot be obtained, and an issue of stable operation still remains to be addressed.

FIG. 5 is a drawing showing waveforms for driving the first sub-field (e.g., SF1 in FIG. 4, (a)) of a given frame.

During the reset period, a voltage, e.g., 300 V (Vw of FIG. 5, (b)), higher than the discharge threshold voltage is applied as a pulse to the X electrodes. This pulse causes gas discharge at all the cells regardless of the lighting status thereof in the preceding sub-field, thereby creating wall charge. When this pulse is gone, discharge starts again because of a voltage generated by the wall charge. Since no voltage difference exists between the electrodes, however, space charge generated by the discharge is neutralized to create the uniform condition of no wall discharge. Although most of the charge is neutralized, some ions and metastable atoms remain in the discharge space, serving as seeds to reliably generate addressing discharge. This is generally referred to as a seeds effect or priming effect.

During the address period after this, a scan pulse (Vy of FIG. 5, (c)) is applied to the Y electrodes serving as scanning electrodes, and address pulses (Va of FIG. 5, (a)) are applied to the address electrodes of the cells that are to emit light, thereby effecting gas discharge. This discharge spreads to the space on the side of the X electrodes, thereby generating wall charge between the X electrodes and the Y electrodes. This scanning is performed with respect to all the display lines.

During the sustain discharge period, sustain pulses of a voltage Vs (about 170 V) are repeatedly applied. At the cells where wall charge is in place by the addressing discharge, the sustain pulse voltage is added to the voltage of wall charge, thereby exceeding the discharge threshold voltage and starting actual discharge. At the cells where no addressing discharge was performed, no discharge is initiated since there is no wall charge.

FIG. 6 is a drawing showing waveforms for driving a sub-field during which no reset discharge of FIG. 5 is performed.

The sub-field shown in FIG. 6 corresponds to SF1 through SF10 of FIG. 4, (b). During the reset period, an erase pulse of a voltage Vb (FIG. 6, (b)) having a gentle slope is applied to all the cells. This causes discharge at the cells that emitted light in the preceding sub-field, thereby erasing wall discharge. Operations during the address period and the sustain discharge period are the same as those of FIG. 5.

FIG. 7 is a drawing showing another configuration of a display panel unit different from that of FIG. 2.

In a display panel unit 10A of FIG. 7, X electrodes and Y electrodes serving as display electrodes are provided in turn at equal intervals so as to cross address electrodes A1 through A4. All gaps between the electrodes are utilized as display lines (L1, L2, . . . ). This configuration is called an ALIS (alternate lightning of surfaces) method, and is disclosed in Japanese Patent No. 2801893. Since all the gaps between the electrodes are utilized as display lines, the number of electrodes is half as many as that of FIG. 2, which provides a basis for a cost reduction and a scale reduction.

FIG. 8 is a drawing showing the principle of light emission of the ALIS (alternate lightning of surfaces) method.

Since all the gaps between electrodes serve as display lines, it is impossible to light up all the display lines simultaneously. Lighting of odd-number lines and even-number lines are temporally separated to effect displaying.

FIG. 9 is a drawing showing a frame configuration of the ALIS method.

One frame is divided into two fields, each of which is comprised of a plurality of sub-fields. The first field is used for the displaying of odd-number lines, and the second field is used for the displaying of even-number lines.

FIG. 10 is a drawing showing driving signal waveforms of the ALIS method.

Details of operations of the ALIS method are disclosed in the Japanese Patent Laid-open Application No. 2000-075835. During the reset period, a pulse having a gentle slope (Vwy of FIG. 10, (c) and (e)) is used to generate weak writing discharge, and a subsequent pulse (−Vey of FIG. 10, (c) and (e)) is used to generate erase discharge. These discharges are weak so as to suppress the intensity of light emission. Because of this, even when all the cells are subjected to this reset discharge in all the sub-fields, the luminance level of the black level does not increase. This corresponds to the configuration of FIG. 4, (b).

As described above, the luminance level of black display can be suppressed to some extent by carefully designing driving signal waveforms and sequences. A contrast ratio achieved to date in the darkroom is about 300:1 to 600:1 or 3000:1. Further, a white luminance of a small area is about 500 cd/m$^2$. When the display apparatus is actually used, an optical filter having a transparency rate of 50 to 60% is situated in front of the panel with an aim of avoiding a contrast reduction in a bright room caused by light reflection on the panel surface. Even when the panel of itself achieves 500 cd/m$^2$, the luminance level after passing through the filter is reduced to less than 300 cd/m$^2$. Television sets using commercially available CRTs have a peak luminance level of about 500 cd/m$^2$, so that plasma displays need to be improved to achieve higher luminance levels. To this end, various photo florescent materials that can achieve higher luminance levels are developed and used in practice. This, however, results in an increase in the luminance level of the black level. If the darkroom contrast is 500:1 with a filter attached to the panel, and the peak luminance level is 500 cd/m$^2$, then, the black-level luminance level is 1 cd/m$^2$. When seeing movies or the like in conditions close to the darkroom, even the luminance level of 1 cd/m$^2$ appears to be rather bright, resulting in a degradation of display quality. In the case of CRTs, a luminance level almost equal to 0 cd/m$^2$ is now available, so that the same level of blackness is expected for plasma display apparatuses as well.

FIG. 11 is a drawing showing relationships between externally provided video signals and operations of a related-art plasma display panel.

FIG. 11 shows (a) frames, (b) a vertical synchronizing signal (Vsync), (c) display data, (d) reset discharge, (e) display status, and (f) light emission conditions.

Data (display data of FIG. 11, (c)) of one frame that constitutes one image screen is supplied each time a vertical synchronizing signal (Vsync of FIG. 11(*b*)) corresponding to one frame is supplied. Data of one frame of a video signal is stored in a storage device (memory) of the apparatus. During a next vertical synchronization period, display data is read from the memory with respect to each sub-field, and is supplied to the driving circuitry to drive the panel. As shown in FIG. 11, (d) through (f), even when the black level having no image data al all is to be displayed, the reset discharge is carried out for each Vsync, so that a luminance of some level is inevitably observed.

Accordingly, there is a need for a plasma display apparatus that reduces the black level luminance level as much as possible.

SUMMARY OF THE INVENTION

It is a general object of the present invention to provide a method and an apparatus that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a method and an apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a method of driving a plasma display panel that includes the steps of detecting, with respect to each cell, whether display data is present, avoiding reset discharge with respect to a cell that is to display a black level because of absence of the display data, and generating reset discharge prior to displaying of the display data with respect to a cell that is to display a non-black level because of presence of the display data.

In the invention as described above, the cells that displays the black level continuously is not subjected to reset discharge, whereas the cells that are to display a non-black level after displaying of the black level are subjected to reset discharge at the start of a frame or a field for displaying the non-black level. Namely, a check as to the presence/absence of the display data is made on a cell-specific basis, and the reset discharge is performed only with respect to a cell that has the display data according to the check. Through the operations as described above, the seeds effect is created by reliably generating reset discharge only at the cells to be used for displaying, so that stable display discharge can be achieved while suppressing light emission to zero levels in black portions. According to this method, an infinite darkroom contrast can be achieved in theory.

According to the present invention, the luminance level of the black level can be reduced relative to the related-art configuration without undermining stable operations of the panel. As a result, a darkroom contrast of 300:1 to 600:1 in the related-art configuration can be improved to 1000:1 to ∞:1.

DESCRIPTION OF THE PREFERRED EMBODIMENTS

In the following, a principle and embodiments of the present invention will be described with reference to the accompanying drawings.

Figure 12:
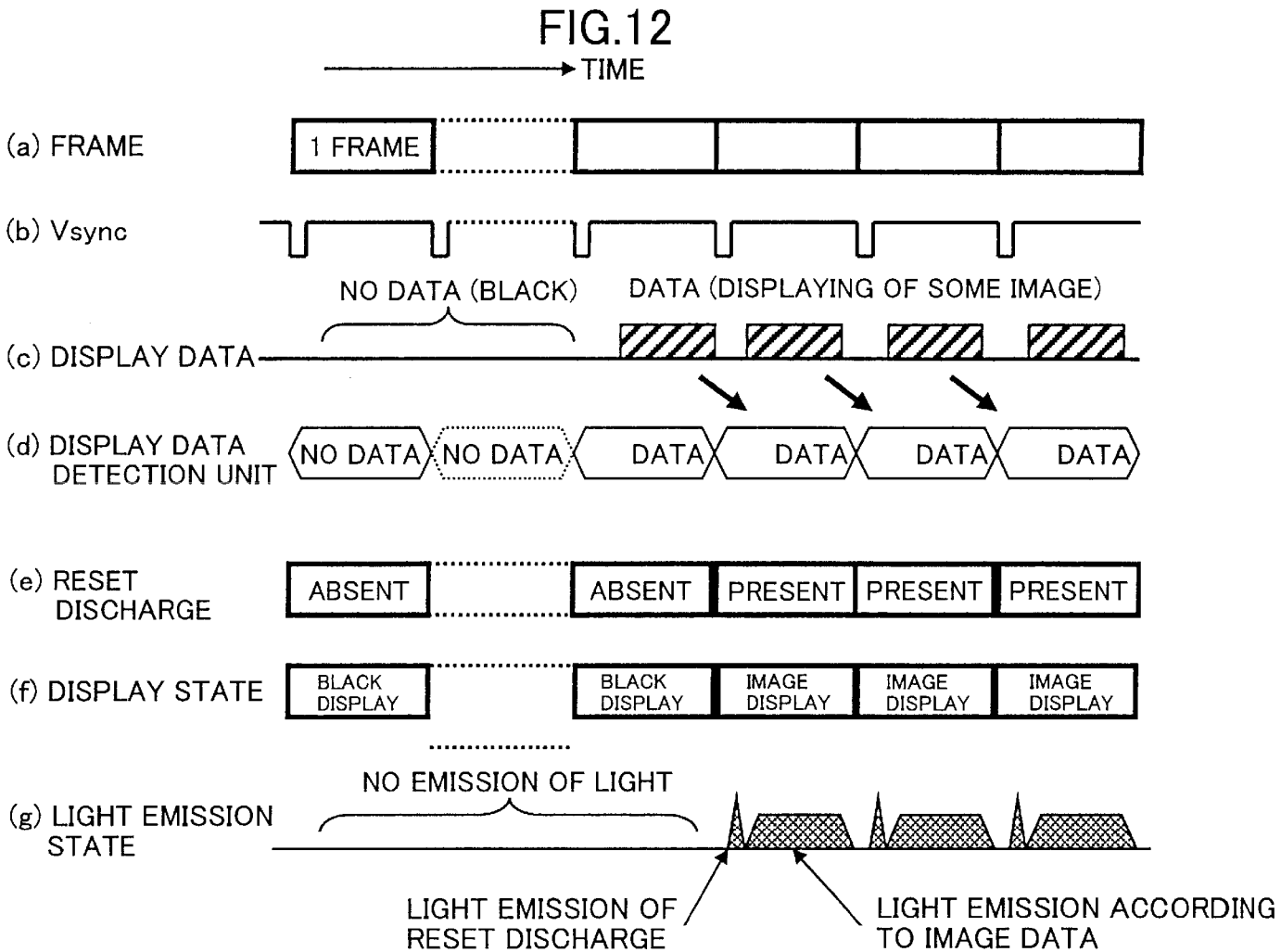
FIG. 12 is a drawing for explaining the principle of the present invention.

FIG. 12 is a drawing for explaining the principle of the present invention.

FIG. 12 shows (a) frames, (b) a vertical synchronizing signal (Vsync), (c) display data, (d) an output of a display data detection unit, (e) reset discharge, (f) display status, and (g) light emission conditions.

In the present invention, the reset discharge is not performed with respect to cells that undergo displaying of consecutive black levels. At the cells in which some non-black level is displayed after a series of continuous black levels, however, a reset discharge is generated at the start of a frame or field that is to display the non-black level. This reset discharge induces a seeds effect, stabilizing subsequent operations. In other words, preparations are made in order to reliably generate display discharge.

As shown in FIG. 12, (f) and (g), reset discharge is not performed at all in the present invention if the black level is repeatedly displayed without any display data. At portions where the black level is displayed, therefore, a luminance level almost equal to 0 cd/m$^2$ can be achieved.

As shown in FIG. 12, (c), when display data is input in a given frame, a display data detection unit detects the presence of display data as shown in FIG. 12, (d). In this manner, it is learned that a normal form of displaying is to be performed during the next vertical synchronization period. At the start of a frame that coincides the beginning of normal displaying, a reset scanning discharge is performed as shown in FIG. 12, (e) and (g). This creates a seeds effect that forms a basis for reliable address discharge in the subsequent sub-field.

The detection of display data and the reset discharge as described above are performed for each display cell. Namely, a check as to whether display data is present is made with respect to each display cell, and the reset discharge is generated solely for the display cells for which the presence of data is detected. If a given area has been displaying the black level consecutively, and if only a portion of this area is to display data from a given frame, then, only the display cells of this data-display portion will be subjected to reset discharging.

Figure 13:
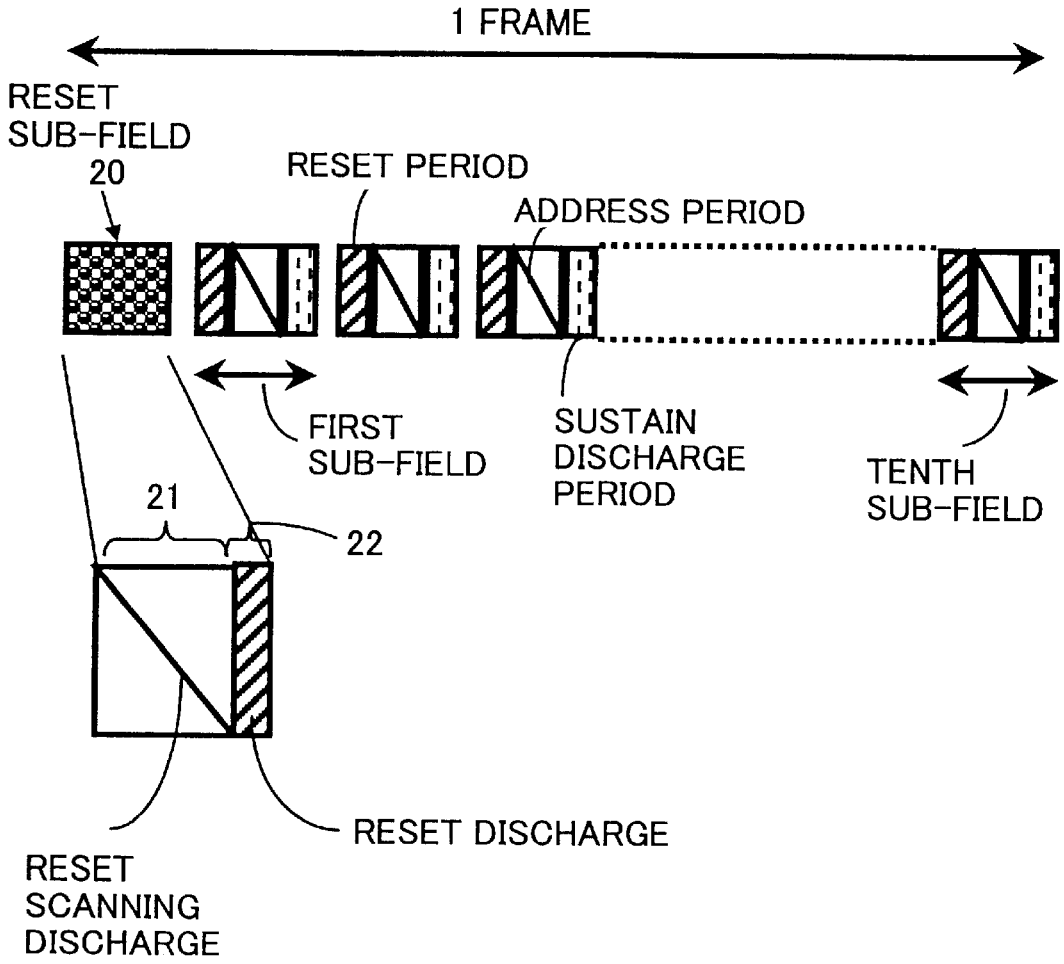
FIG. 13 is a drawing for explaining a frame configuration according to the present invention.

FIG. 13 is a drawing for explaining a frame configuration according to the present invention.

In order to implement the reset operation as described above, the present invention sets aside a period dedicated for the reset purpose (hereinafter referred to as a reset sub-field). As shown in FIG. 13, the reset sub-field 20 is provided with scanning pulses and address pulses that are successively applied to generate writing discharge. Namely, the reset sub-field 20 includes a reset scanning period 21 for address scanning to generate writing discharge, and includes a reset discharge period 22 for reset discharge with respect to the cells that were written.

During the reset scanning period 21, all the cells that are to display in a sub-field within the current frame or field are subjected to the reset scanning discharge. Since the displaying of the black level has been repeated immediately prior to the reset scanning discharge, writing discharge is not easy to take place because of lack or insufficiency of the seeds effect. In consideration of this, pulses having a longer duration and/or a higher voltage than scanning pulses of ordinary sub-fields are used so as to generate discharge with certainty.

After reset scanning is carried out for all the display lines, voltage pulses that trigger only the cells having wall charge formed therein are supplied during the reset discharge period 22. This reset discharging creates the seeds effect.

Through the operations as described above, the seeds effect is created by generating reset discharge with certainty only at the cells to be used for displaying, so that stable display discharge can be achieved while suppressing light emission to zero levels in black portions. According to this method, an infinite darkroom contrast can be achieved in theory.

Figure 14:
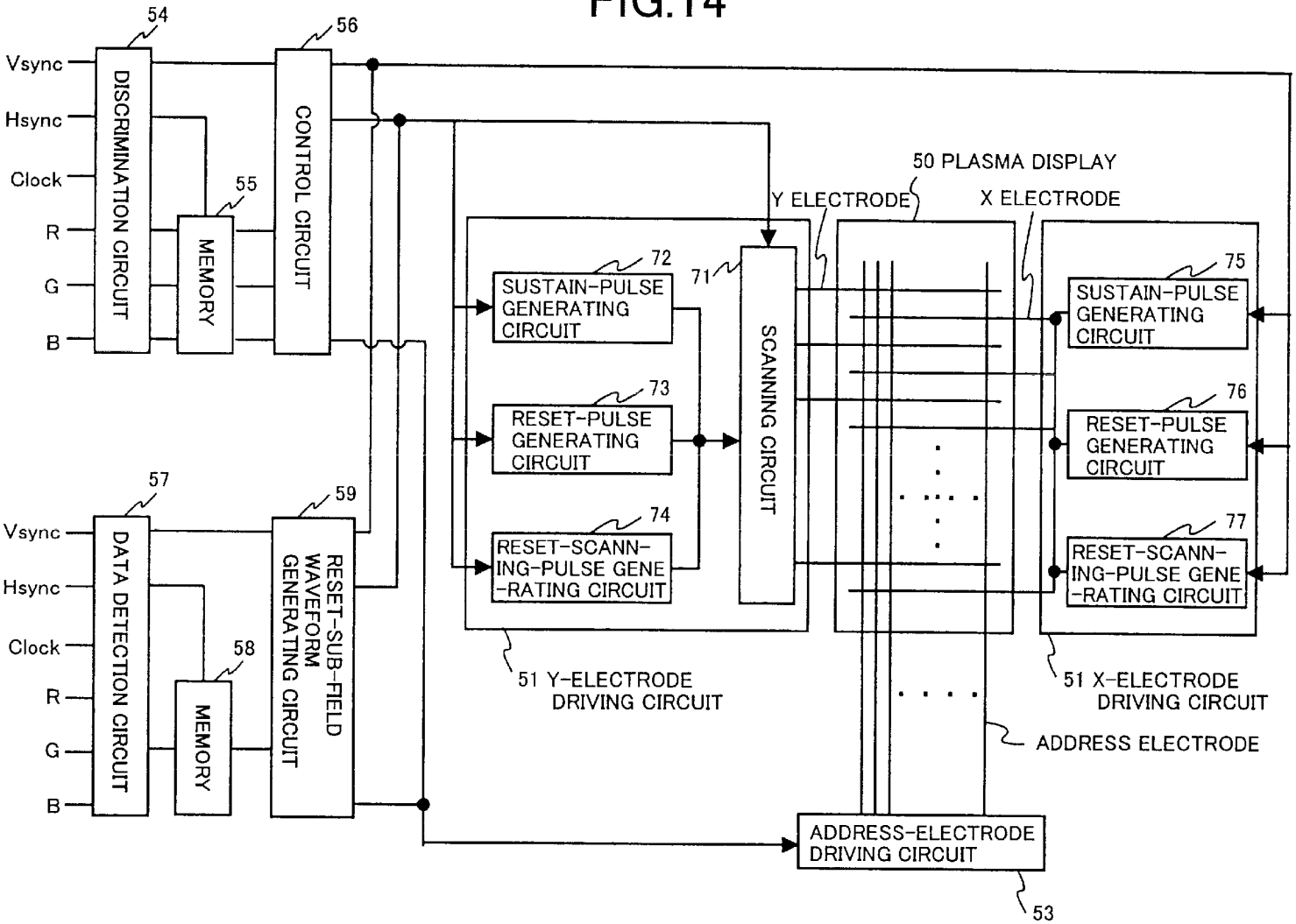
FIG. 14 is a drawing showing a configuration of a plasma display apparatus according to an embodiment of the present invention.

FIG. 14 is a drawing showing a configuration of a plasma display apparatus according to an embodiment of the present invention.

The plasma display apparatus of FIG. 14 includes a plasma display panel 50, a Y-electrode driving circuit 51, an X-electrode driving circuit 52, an address-electrode driving circuit 53, a discrimination circuit 54, a memory 55, a control circuit 56, a data detection circuit 57, a memory 58, a reset-sub-field waveform generating circuit 59. The Y-electrode driving circuit 51 includes a scanning circuit 71, a sustain-pulse generating circuit 72, a reset-pulse generating circuit 73, and a reset-scanning-pulse generating circuit 74. The X-electrode driving circuit 52 includes a sustain-pulse generating circuit 75, a reset-pulse generating circuit 76, and a reset-scanning-pulse generating circuit 77. In FIG. 14, the data detection circuit 57, the memory 58, the reset-subfield waveform generating circuit 59, the reset-scanning-pulse generating circuit 74, and the reset-scanning-pulse generating circuit 77 are newly provided in addition to a conventional configuration for the purpose of implementing the present invention.

The discrimination circuit 54 receives a vertical synchronizing signal Vsync, a horizontal synchronizing signal Hsync, and a clock signal Clock, and further receives RGB signals each comprised of 8 bits as data signals. The discrimination circuit 54 stores the RGB data in the memory 55 as the display data by using the vertical synchronizing signal Vsync. The control circuit 56 controls the Y-electrode driving circuit 51, the X-electrode driving circuit 52, and the address-electrode driving circuit 53, thereby displaying the display data stored in the memory 55 on the plasma display panel 50. To this end, the scanning circuit 71 of the Y-electrode driving circuit 51 scans the Y electrodes, and the address-electrode driving circuit 53 drives the address electrodes, so that writing discharge is generated to write the data in the plasma display panel 50. Further, the sustain-pulse generating circuit 72 and the sustain-pulse generating circuit 75 generate sustain discharge between the Y electrodes and the X electrodes at the display cells that have the data written therein.

The data detection circuit 57 receives receives the vertical synchronizing signal Vsync, the horizontal synchronizing signal Hsync, and the clock signal Clock, and further receives the RGB signals each comprised of 8 bits as data signals. The data detection circuit 57 detects the presence/absence of data in the input data signals RGB with respect to each cell by using the vertical synchronizing signal Vsync and the horizontal synchronizing signal Hsync, and writes data indicative of the presence/absence of data in the memory 58. The reset-sub-field waveform generating circuit 59 controls the Y-electrode driving circuit 51 and the address-electrode driving circuit 53 based on the data of the memory 58, and performs the reset-scanning discharge during the reset scanning period 21 of the reset sub-field 20. Thereafter, the reset-sub-field waveform generating circuit 59 generates reset discharge during the reset discharge period 22 of the reset sub-field 20.

Figure 15:
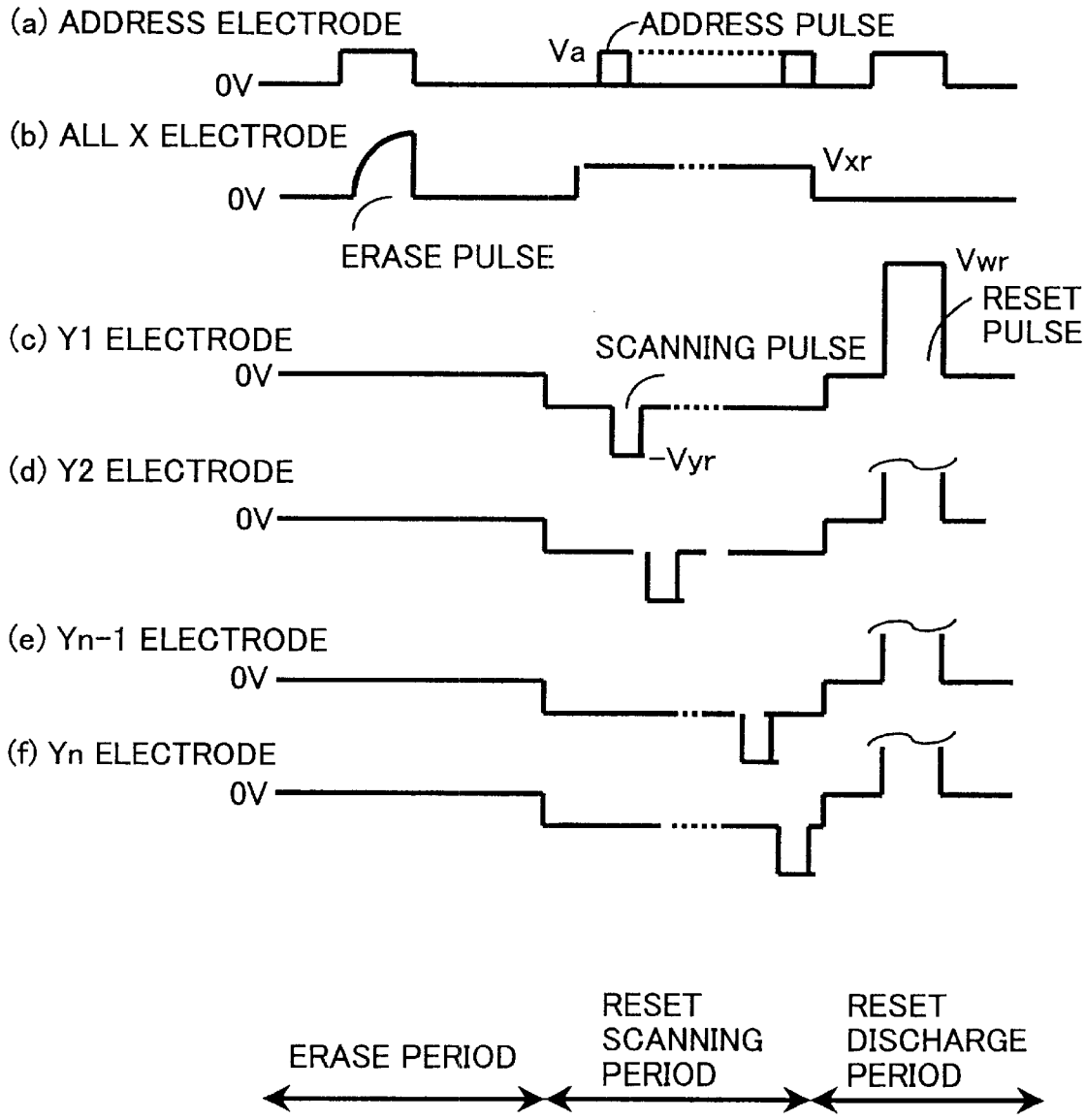
FIG. 15 is a drawing showing driving signal waveforms of individual electrodes during a reset sub-field according to the embodiment of the present invention.

FIG. 15 is a drawing showing driving signal waveforms of individual electrodes during the reset sub-field according to the embodiment of the present invention.

In order to erase electric charge at the cells that lit in a previous sub-field, an erase pulse is supplied all cells to perform erase discharge. Although this erase pulse is supplied to all the cells, the erase discharge actually takes place only at the cells that lit in the preceding sub-field. This is because a relatively low voltage can trigger discharge because of remnants of wall charge if the cells were discharging in the preceding sub-field.

During the following reset scanning period, pulse signals (−Vyr) generated by the reset-scanning-pulse generating circuit 74 are supplied as scanning pulses to the Y electrodes by the scanning circuit 71 in the same manner as during the addressing period of an ordinary sub-field. At the same time, a pulse signal (Vxr) generated by the reset-scanning-pulse generating circuit 77 is applied to the X electrodes. Further, address pulses (Va) generated by the address-electrode driving circuit 53 are supplied to the address electrodes. This generates discharge at the cells that are scheduled to light in the following sub-field. This operation is performed with respect to all the display lines.

During the following reset discharge period, a reset pulse having a voltage Vwr (about 200 V) is applied to the Y electrodes. This pulse voltage is added to the wall voltage generated by the reset scanning discharge, resulting in the generation of discharge, which in turn generates wall charge. When the pulse is stopped, the voltage of the wall charge generates discharge again, thereby neutralizing the charge. Since the reset scanning discharge was not performed with respect to the calls that are scheduled to display the black level in the following set of sub-fields, the reset discharge does not take place at those cells during the reset discharge period, thereby avoiding light emission. Here, the duration of a pulse applied during the reset scanning period is set equal to about 3 micro seconds that is twice as long as the scanning pulse duration of an ordinary sub-field, which is 1.5 micro seconds. Further, the applied voltage is set higher than the voltage Vy of an ordinary sub-field that is −150 V, and may be set to 180 V. Moreover, the voltage applied to the X electrodes is also set about 20 V higher than the voltage Vx of an ordinary sub-filed, and may be set to 70 V. By instituting proper conditions as described here, it can be ensured that the reset scanning discharge is generated with certainty.

The voltage level and the pulse width described above may be set properly in accordance with the panel characteristics, the driving duration of an ordinary sub-field, etc. Further, it is also an effective measure to raise the voltage level of the address pulses solely during the reset sub-field. Further, the erase pulse having a gentle slope used during the erase period may result in a failure to fully neutralize the wall charge, thereby leaving a minute residue of electric charge. This residue has such a polarization that negative charge remains on the side of Y electrodes, which serves as an advantage since it is the same polarization as the pulses for the following reset scanning discharge.

Figure 16:
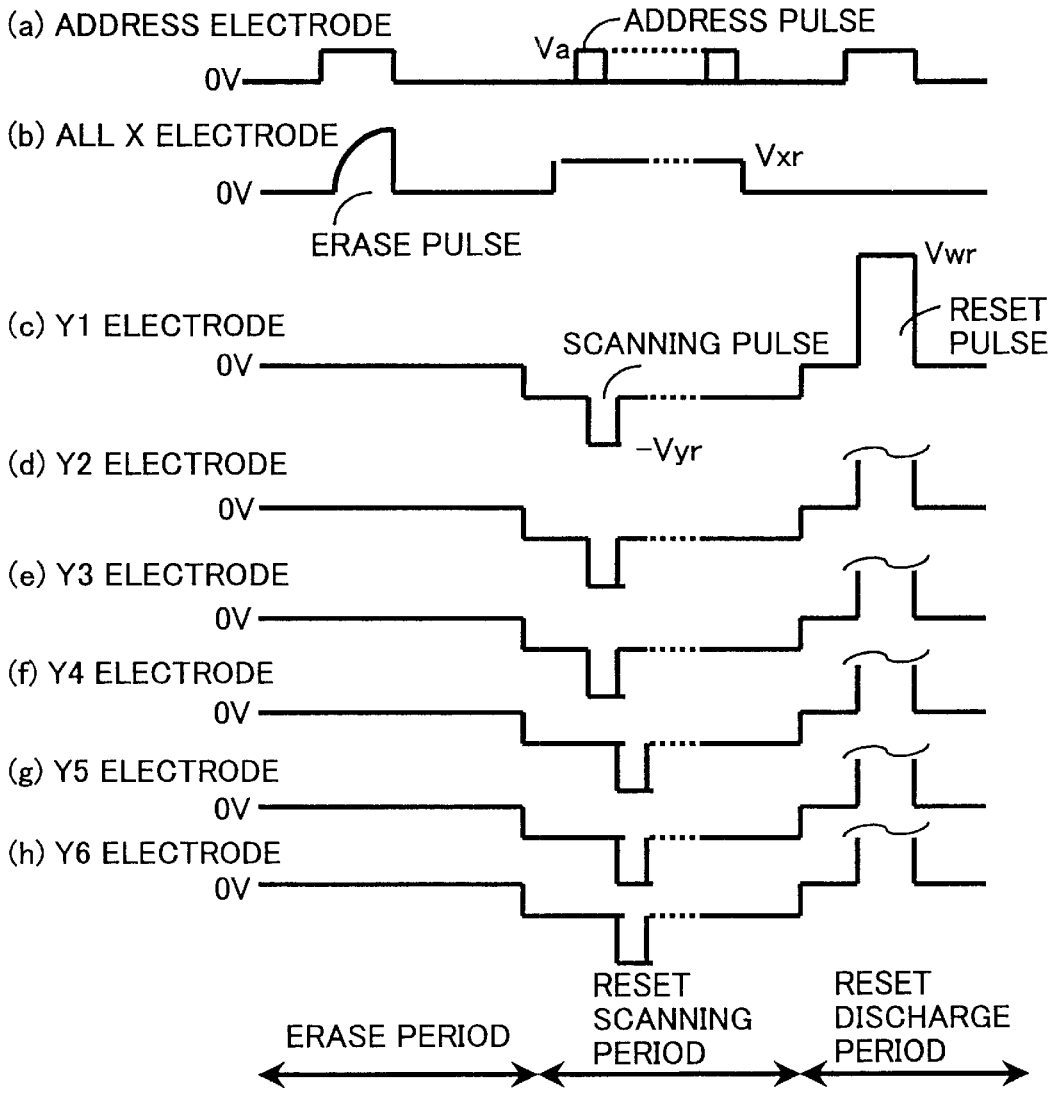
FIG. 16 is a drawing showing another example of driving signal waveforms used during the reset sub-field according to the embodiment of the present invention.

FIG. 16 is a drawing showing another example of driving signal waveforms used during the reset sub-field according to the embodiment of the present invention.

According to the present invention, a period of time is newly set aside for the reset sub-field, which creates a concern that a sufficient time period may not be left to be allocated to other sub-fields. In order to obviate this problem, the reset scanning is simultaneously performed with respect to a plurality of lines, thereby reducing a time period of the reset sub-field.

In an example of FIG. 16, the reset scanning discharge is performed by applying reset scanning pulses to three lines at once. If cells of three lines that are subjected to simultaneous scanning includes a cell that is scheduled to light in a subsequent sub-field, an address pulse is supplied so as to simultaneously generate discharge at the cells of these three lines. This makes shorter the reset scanning period. Also, this makes it possible to broaden the width of the reset scanning pulses compared with the case of FIG. 15, thereby making certain that discharge is generated. Even if the pulse width is set equal to 6 micro seconds that is twice as long as the pulse width of FIG. 15, a total time reduction by the factor of two thirds can be achieved. According to this scheme, reset discharge will result in emission of light by excessive cells that are not scheduled to light if these excessive cells are adjacent to the very cell that is scheduled to light. At a portion where four or more consecutive lines are schedules to display the black level, however, there is no reset discharge, and, thus, there is no emission of light. By and large, no significant effect can be found with respect to contrast between the black display portion and the non-black display portion when the entirety of a screen is taken into account.

Figure 17A:
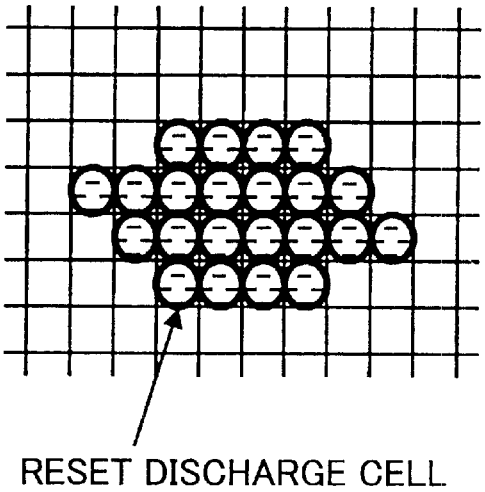
FIGS. 17A through 17C are drawings showing the way the light is emitted when a panel is operated by the driving signal waveforms of FIG. 15.
Figure 17B:
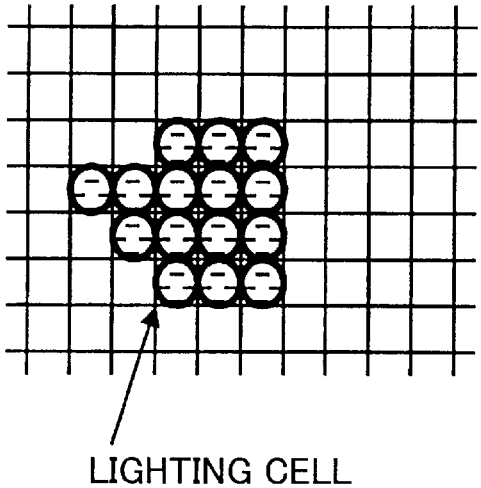
Figure 17C:
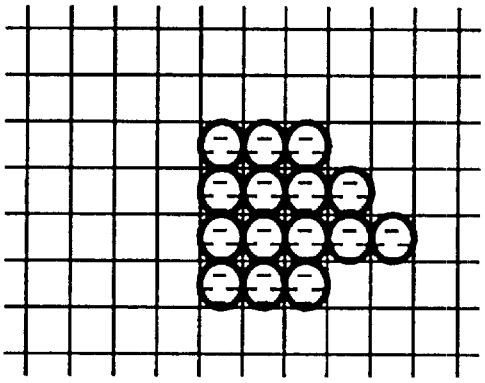

FIGS. 17A through 17C are drawings showing the way the light is emitted when the panel is operated by the driving signal waveforms of FIG. 15.

The first sub-field shown in FIG. 17B and the second sub-field shown in FIG. 17C are scheduled to display patterns as shown. In the reset sub-field as shown in FIG. 17A, reset discharge is carried out at cells that are scheduled to emit light in either the first sub-field or the second sub-field. The emission of light by the reset discharge is followed by the emission of light of the subsequent sub-fields, thereby creating no visual appearance that appears to be abnormal.

Figure 18A:
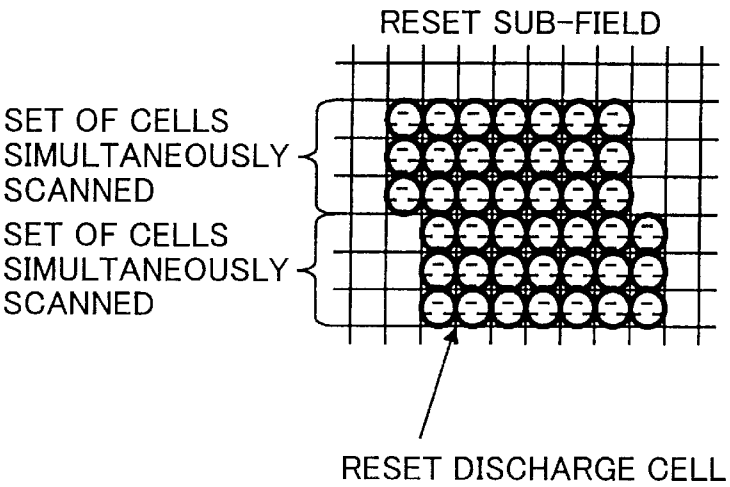
FIGS. 18A through 18C are drawings showing the way the light is emitted when the panel is operated by the driving signal waveforms of FIG. 16.
Figure 18B:
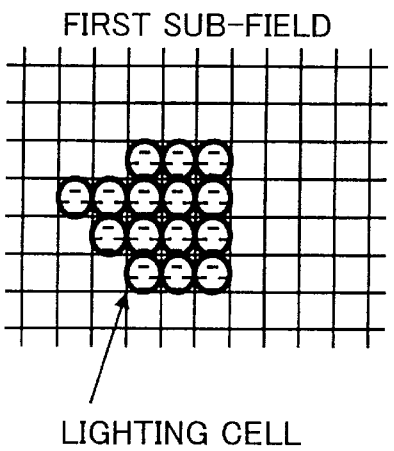
Figure 18C:
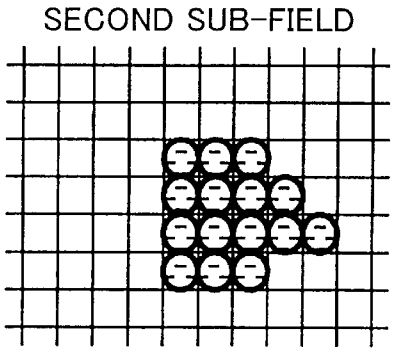

FIGS. 18A through 18C are drawings showing the way the light is emitted when the panel is operated by the driving signal waveforms of FIG. 16.

The first sub-field shown in FIG. 18B and the second sub-field shown in FIG. 18C are scheduled to display patterns as shown. The Y electrodes receive the scanning pulse simultaneously for 3 lines. In the reset sub-field as shown in FIG. 18A, therefore, reset discharge is carried out at an area combining three lines together if this area includes cells scheduled to emit light in either one of the subsequent sub-fields.

Figure 19:
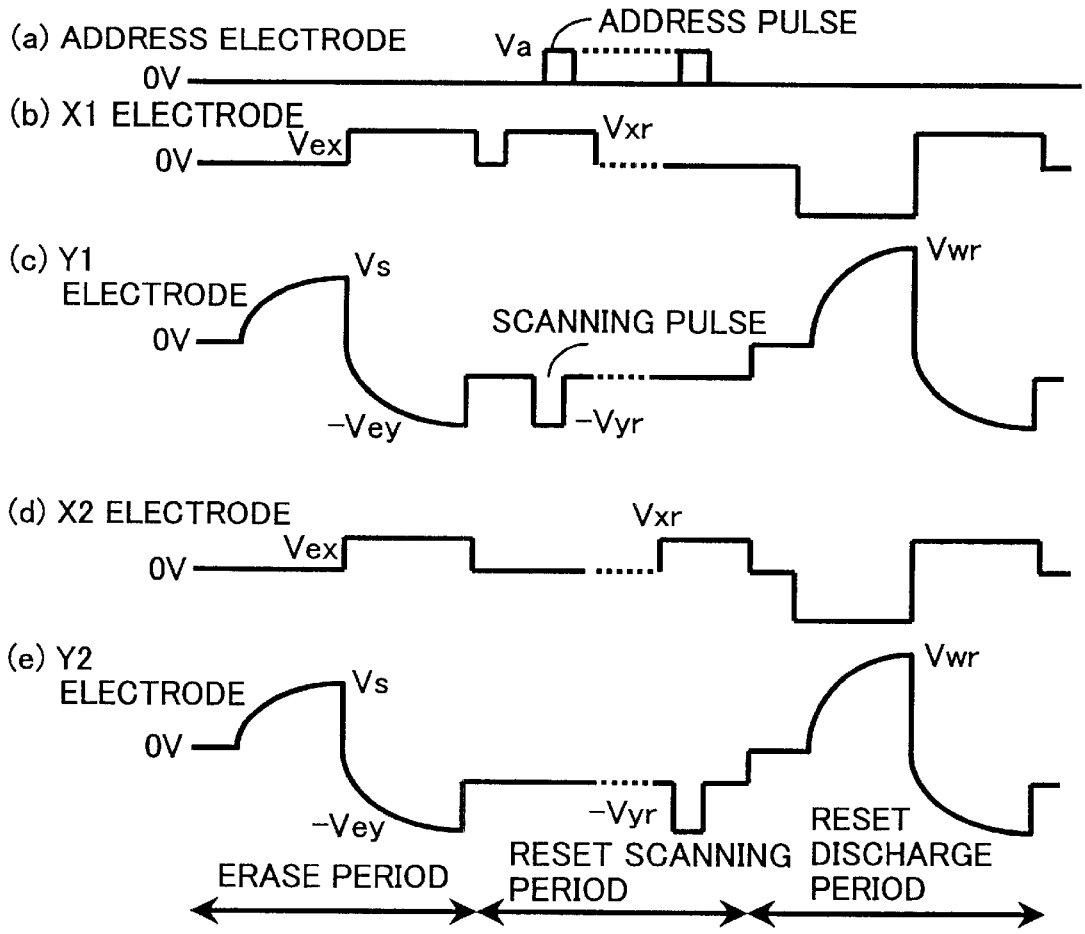
FIG. 19 is a drawing showing an example of various electrode driving signal waveforms used when the present invention is applied to an ALIS-type plasma display panel.

FIG. 19 is a drawing showing an example of various electrode driving signal waveforms used when the present invention is applied to the ALIS-type plasma display panel.

Figure 1:
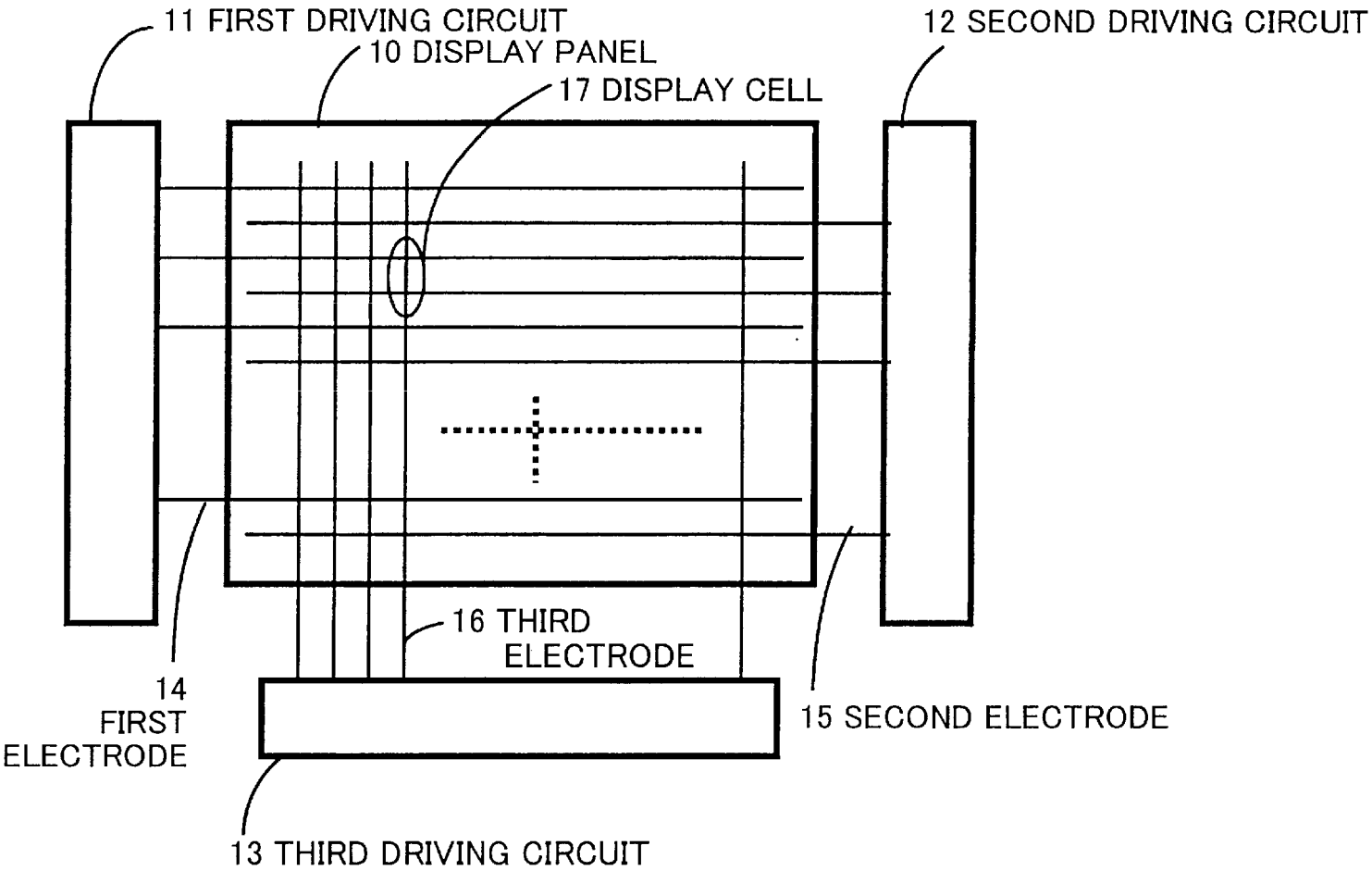
FIG. 1 is a diagram showing a schematic configuration of a plasma display apparatus.
Figure 2:
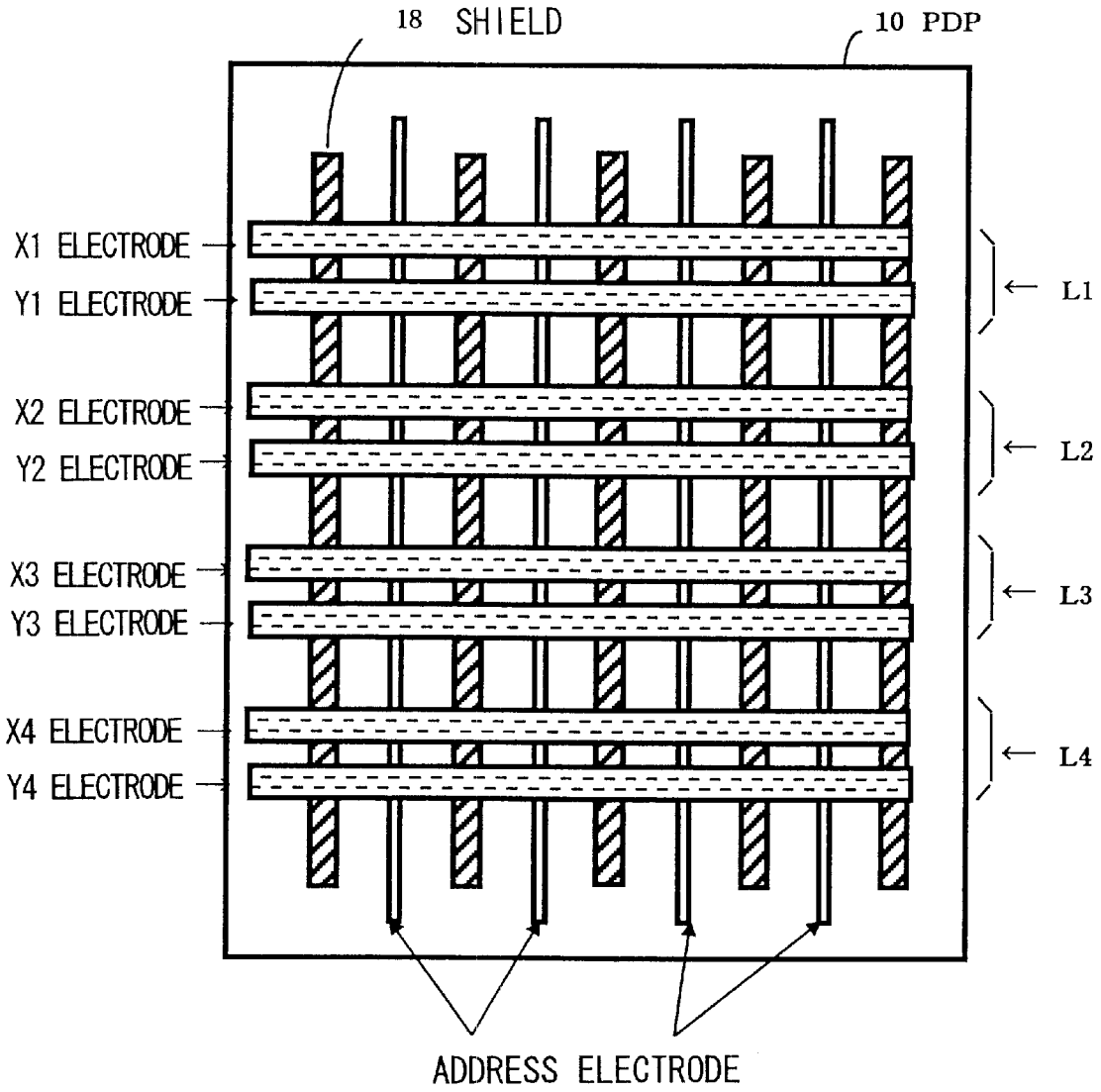
FIG. 2 is a drawing showing details of a display panel unit of the apparatus shown in FIG. 1.
Figure 3:
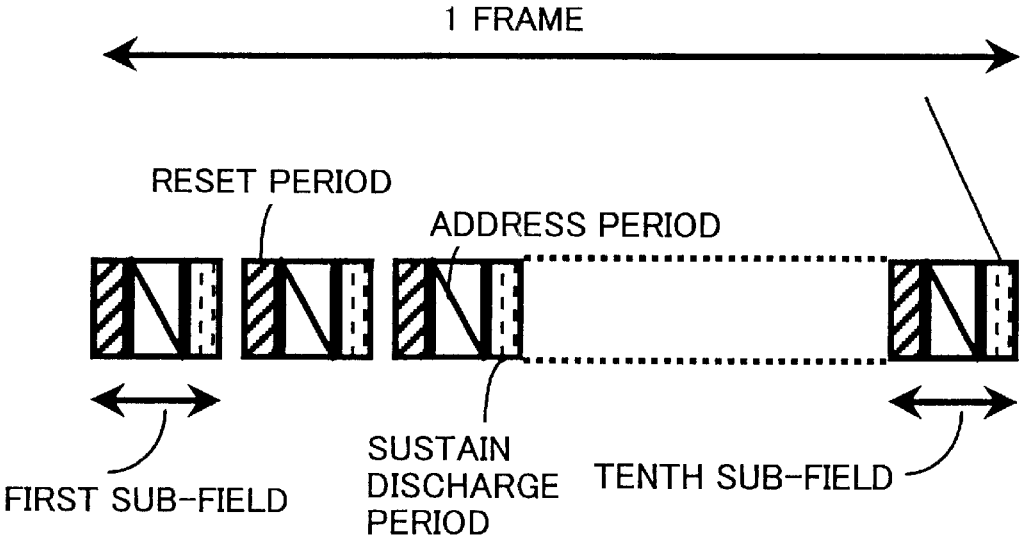
FIG. 3 is a drawing showing a frame configuration for explaining driving sequences.
Figure 4:
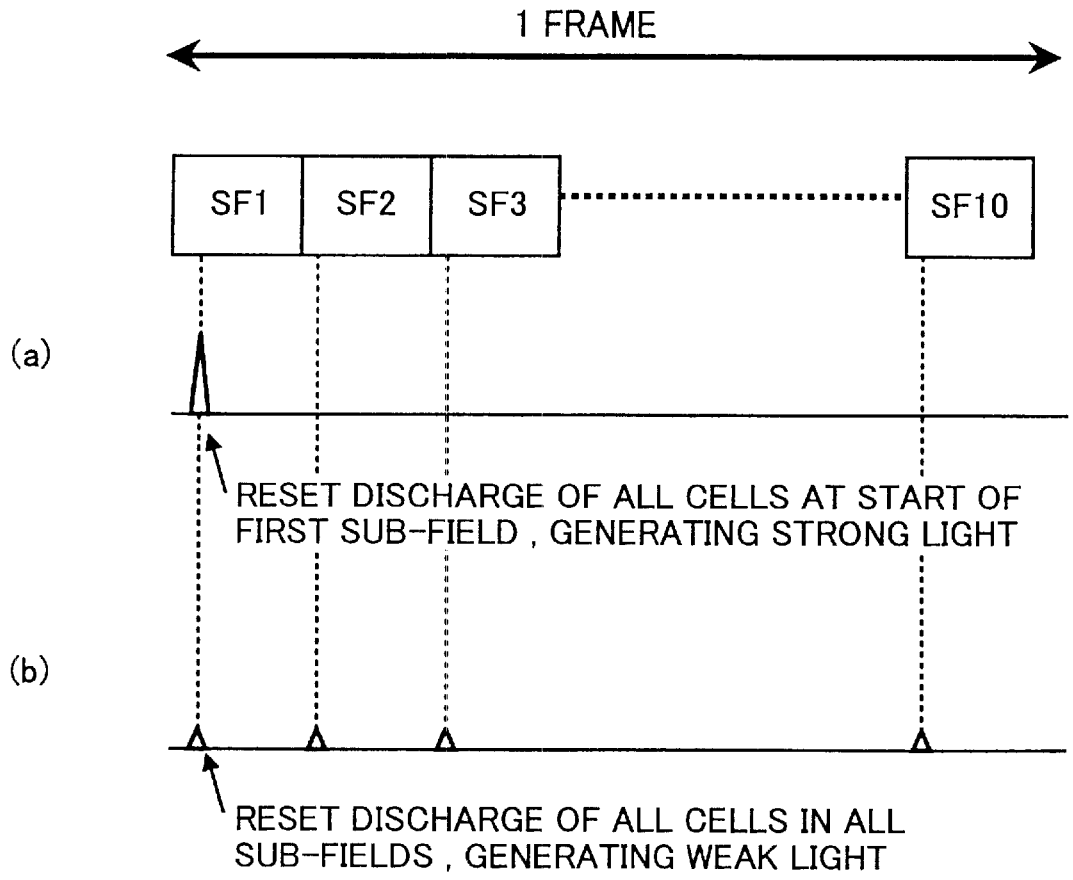
FIG. 4 is a drawing showing the way a reset discharge emits light.
Figure 5:
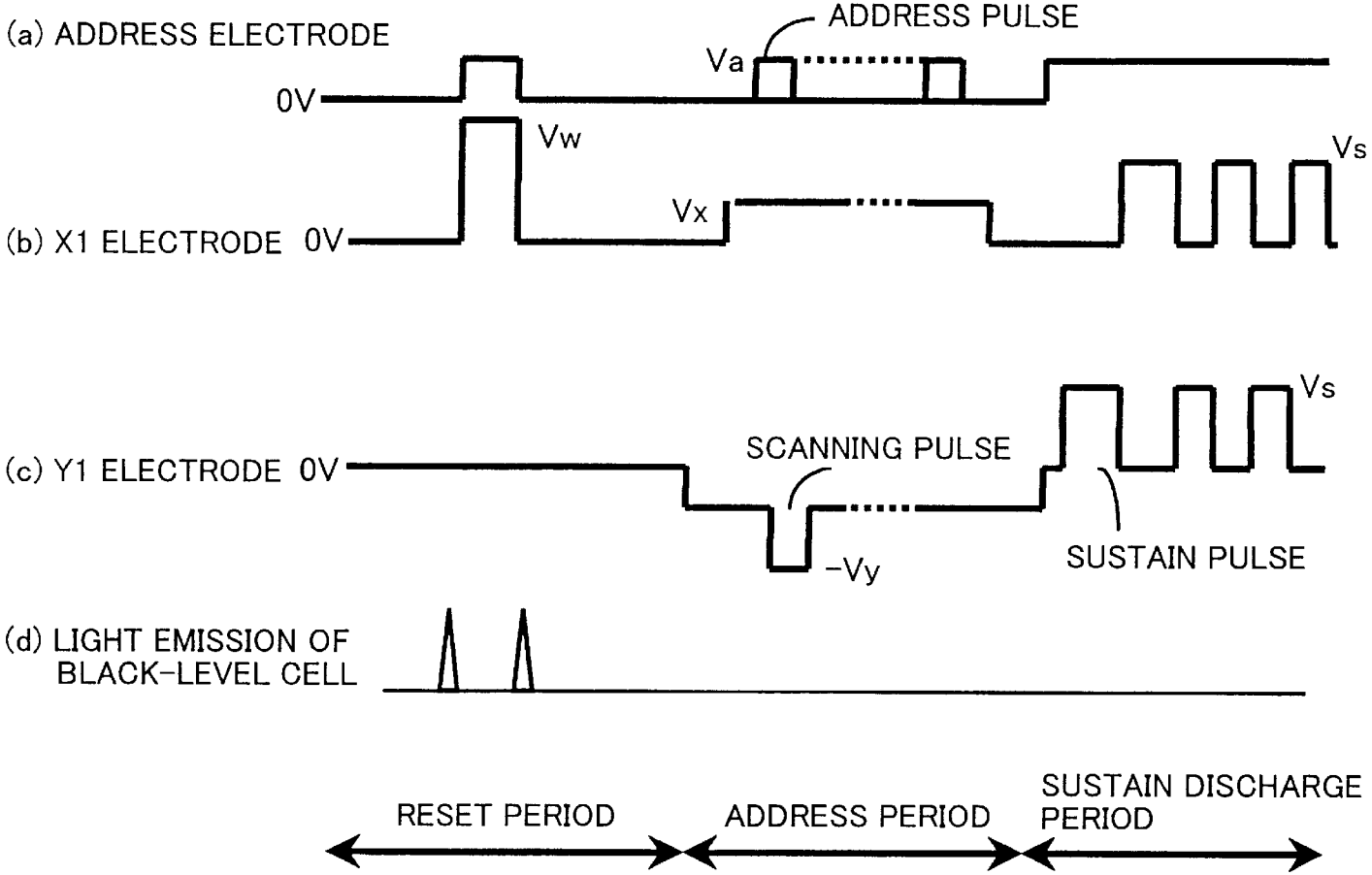
FIG. 5 is a drawing showing waveforms for driving the first sub-field of a given frame.
Figure 6:
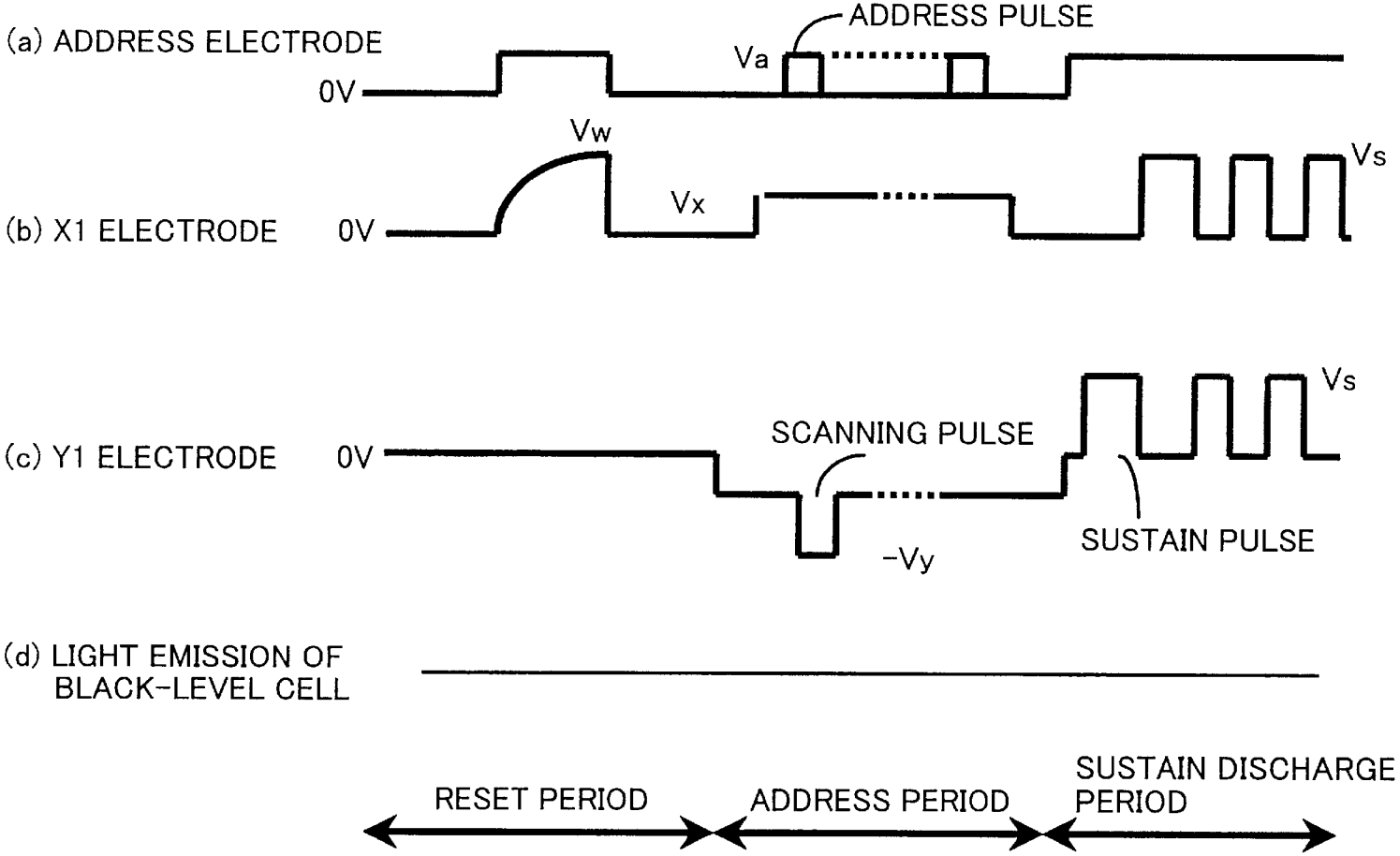
FIG. 6 is a drawing showing waveforms for driving a sub-field during which no reset discharge of FIG. 5 is performed.
Figure 7:
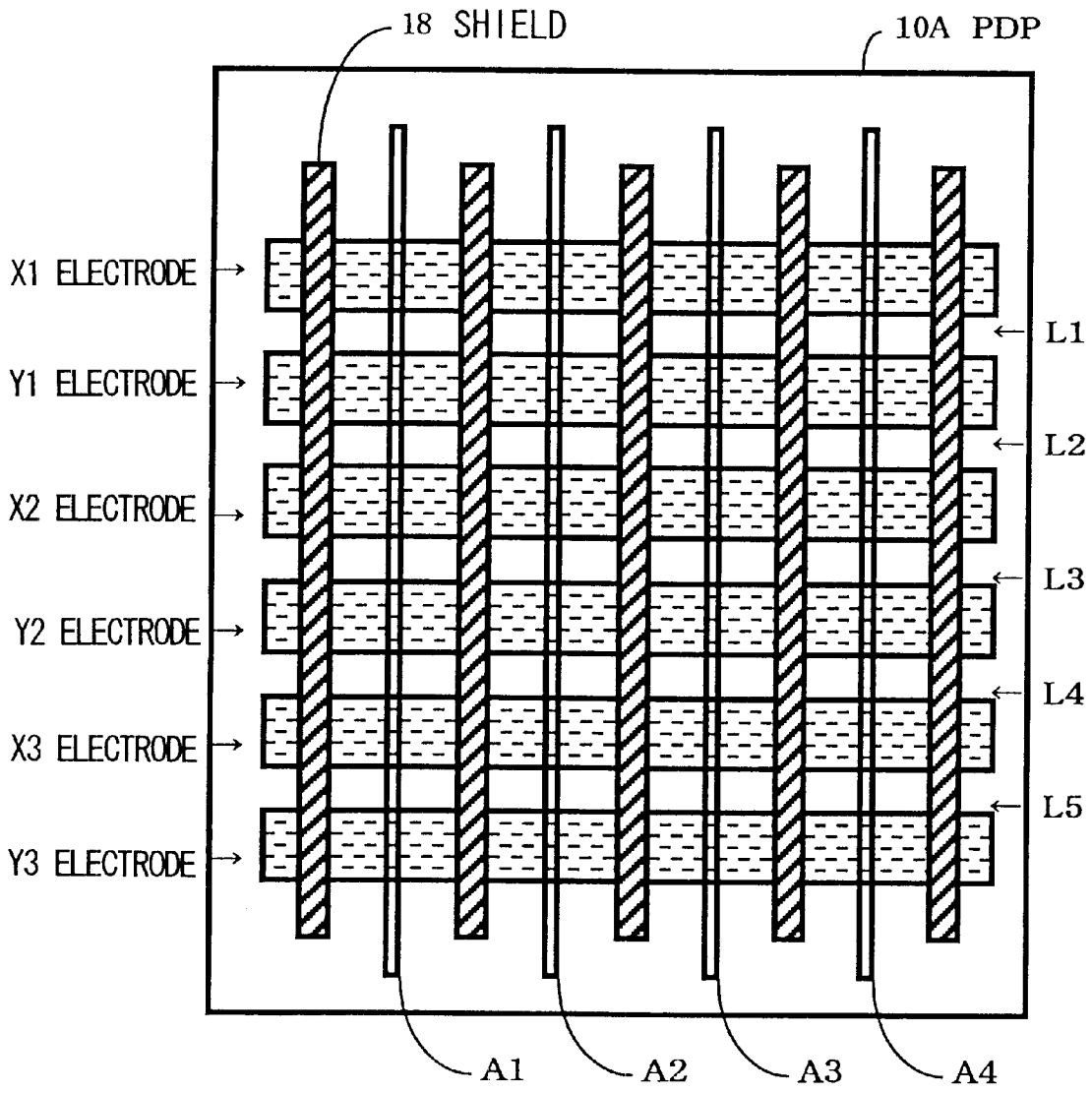
FIG. 7 is a drawing showing another configuration of a display panel unit different from that of FIG. 2.
Figure 8:
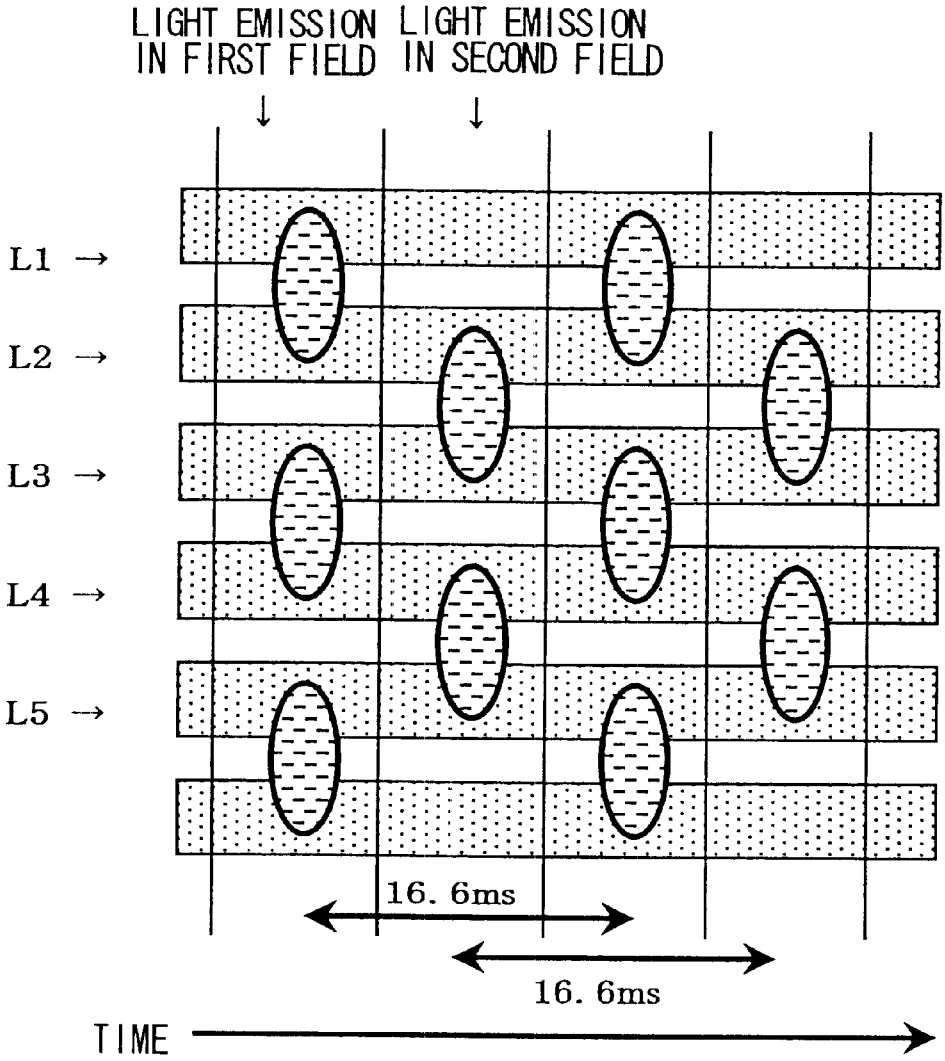
FIG. 8 is a drawing showing a principle of light emission of an ALIS method.
Figure 9:
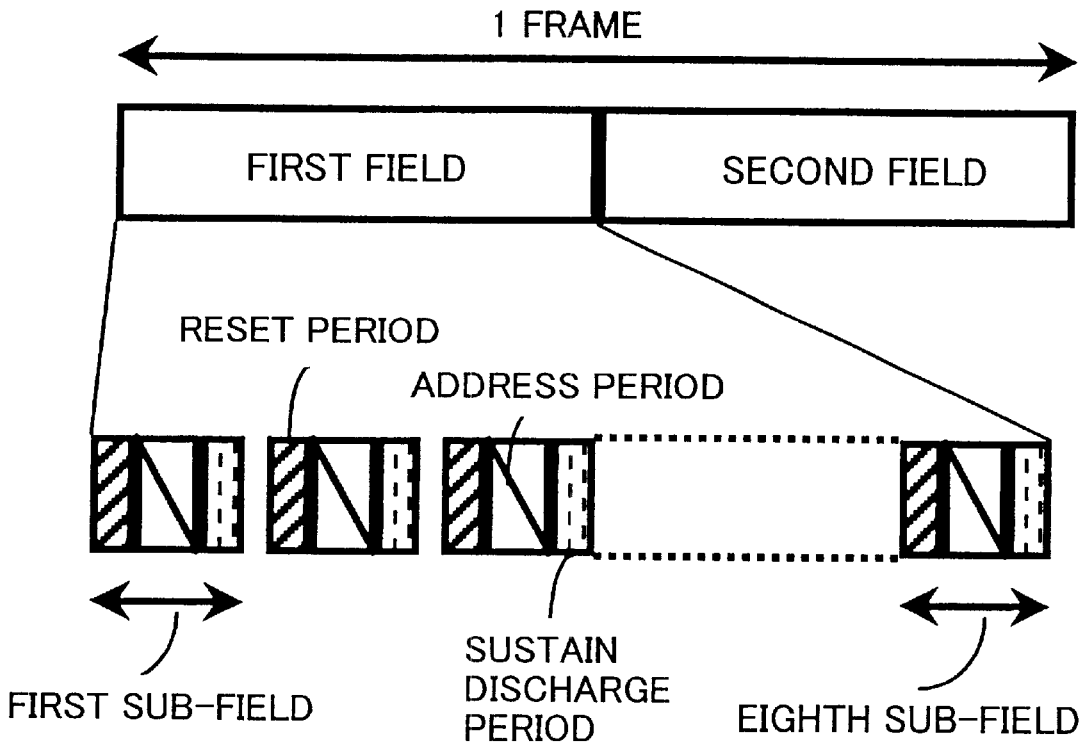
FIG. 9 is a drawing showing a frame configuration of the ALIS method.
Figure 10:
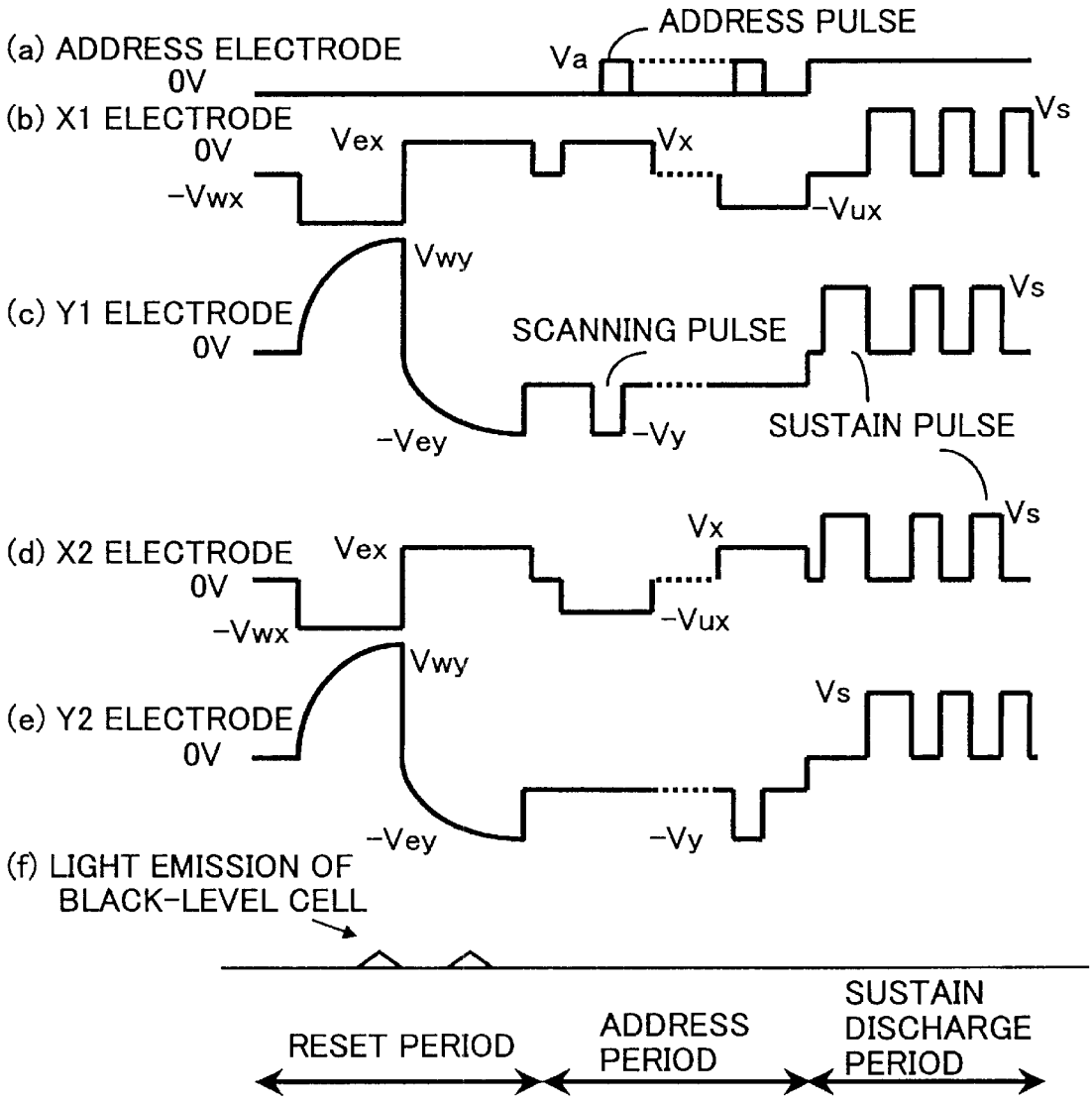
FIG. 10 is a drawing showing driving signal waveforms of the ALIS method.
Figure 11:
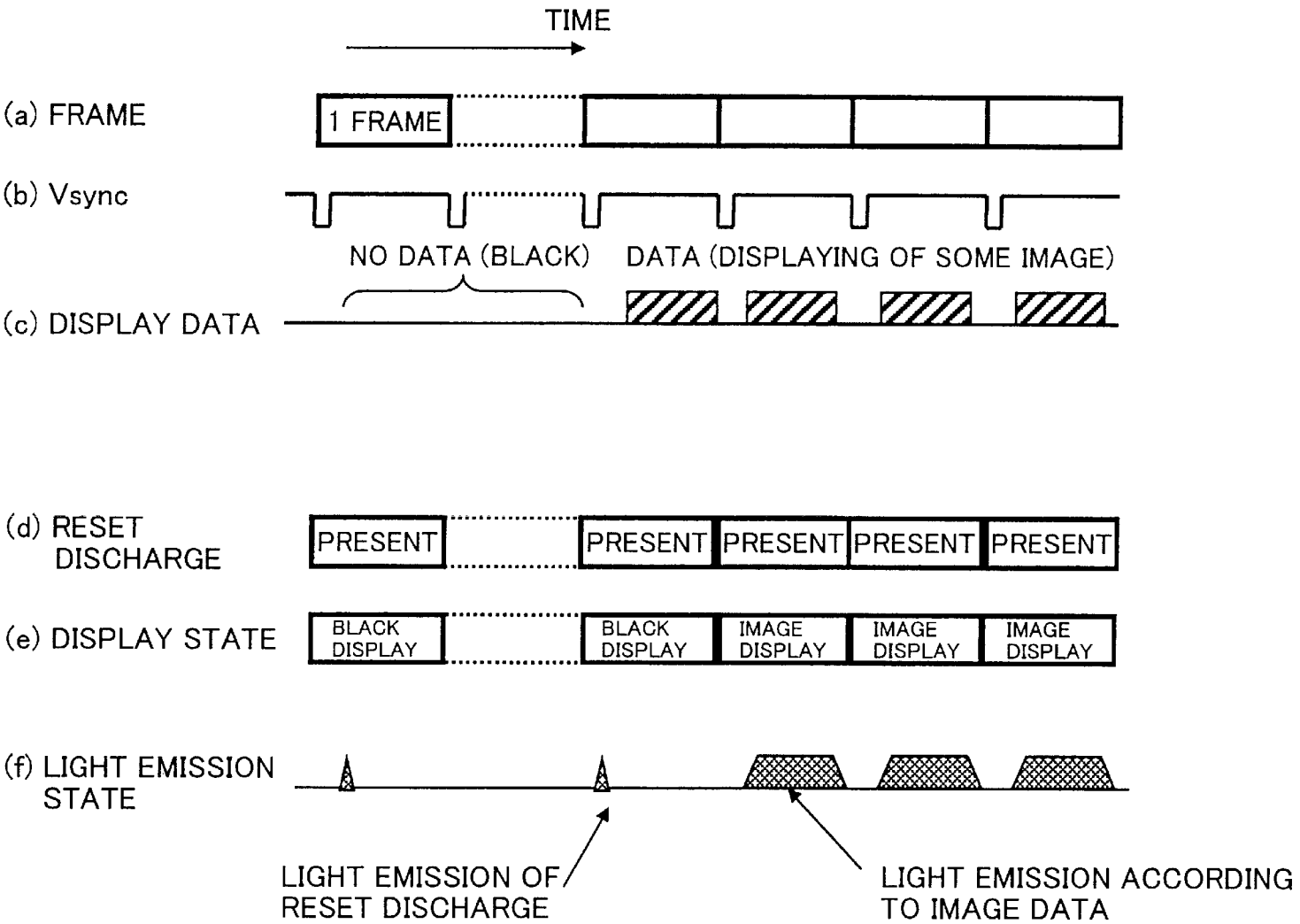
FIG. 11 is a drawing showing relationships between externally provided video signals and operations of a related-art plasma display panel.

Driving signal waveforms of FIG. 19 corresponds to a case in which the ALIS-type panel shown in FIG. 7 is driven by the driving signal waveforms of the reset sub-field shown in FIG. 10. Basic operations are the same as those of FIG. 15, and a description thereof will be omitted. It should be noted that even when these driving signal waveforms for the ALIS method are used, multiple lines may be subjected to the reset scanning so as to reduce an operation time as shown in FIG. 16.

Figure 20A:
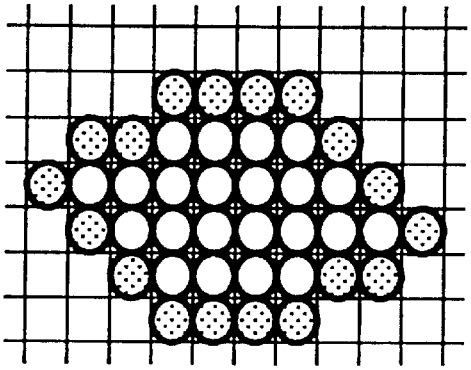
FIGS. 20A through 20C are drawings for explaining another embodiment of reset discharge patterns.
Figure 20B:
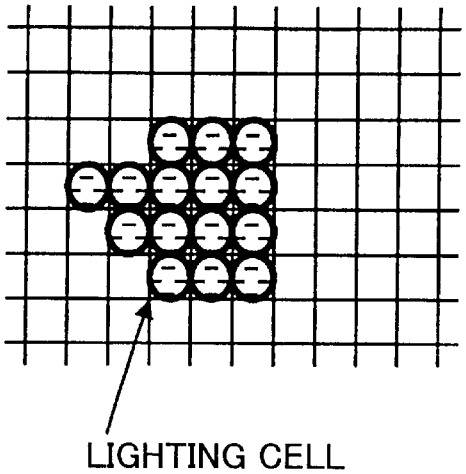
Figure 20C:
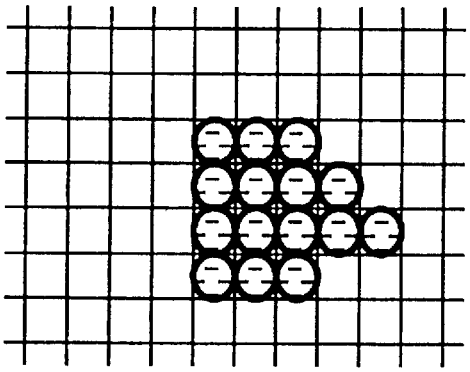

FIGS. 20A through 20C are drawings for explaining another embodiment of reset discharge patterns.

As shown in FIGS. 20B and 20C, cells that are scheduled to emit light in the first sub-field and in the second sub-field form the same patterns as those of FIGS. 17B and 17C. What differs from the case of FIGS. 17A through 17C is that reset discharge is performed with respect to cells including cells scheduled to emit light and cells adjacent thereto as shown in FIG. 20A. The reset-sub-field waveform generating circuit 59 attends to the control of a decision as to which cells are to be reset. Use of such a reset discharge pattern achieves more stable operations in the case of a high definition panel or an ALIS panel, which is susceptible to the influence of electric charge dissipation because of the close arrangement of adjacent cells.

In general, a cell that is to display the black level at a position adjacent to a cell to emit light may have electric charge seeping from the cell to emit light. This changes electric charge conditions inside the cells, possibly affecting the operation of addressing discharge. If the reset discharge pattern as described above is used, however, a black-level cell that is adjacent to a light emission cell is subjected to the reset scanning discharge, thereby ensuring a stable condition. This is particularly advantageous for a high definition panel or an ALIS-type panel in which cells adjacent to each other along the vertical direction are relatively close.

Figure 21:
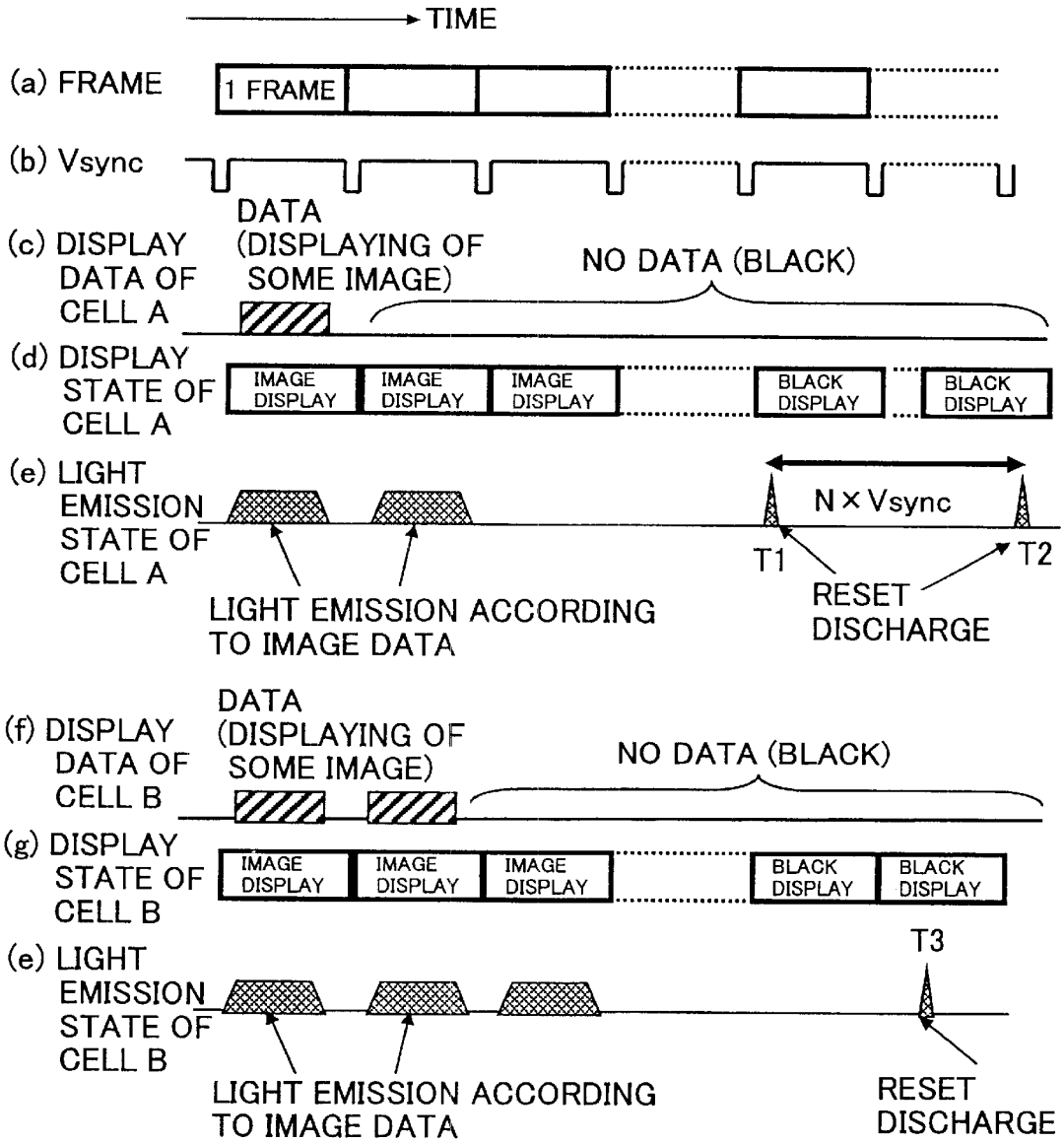
FIG. 21 is a drawing for explaining an embodiment in which reset discharge is compulsorily performed at constant intervals.

FIG. 21 is a drawing for explaining an embodiment in which reset discharge is compulsorily performed at constant intervals.

According to the present invention, the seeds effect weakens as the displaying of the black level continues for a long time, and, as a result, the probability of reset scanning discharge generation decreases. In order to cope with this, this embodiment periodically generates a compulsory reset discharge at proper intervals (N×Vsync) if the displaying of the black level continues. Driving signal waveforms used in this embodiment are identical to those of FIG. 15 or those of FIG. 19.

As shown in FIG. 21, a cell A has reset discharges at time T1 and time T2. Since a cell B attended to displaying operations one Vsync longer than the cell A, a reset discharge is performed at time T3 that is delayed by one Vsync. In this manner, this embodiment determines the timing for periodic reset discharge according to the last Vsync period that is used for displaying. N shown here (N×Vsync: periodic reset discharge interval) is 10, for example, thereby generating reset discharge at 0.16 second intervals.

In general, human vision perceives flickers for light emissions of less than 50 Hz. Even when the reset discharge of the present invention occurs at intervals shorter than 50 Hz, e.g., occurs at 1-Hz intervals or few-second intervals, no flicker or disturbing effect is perceived. If the periodic compulsory discharge is not performed with respect to the entire screen, but is carried out on cell-specific basis, quality is further improved.

Figure 22:
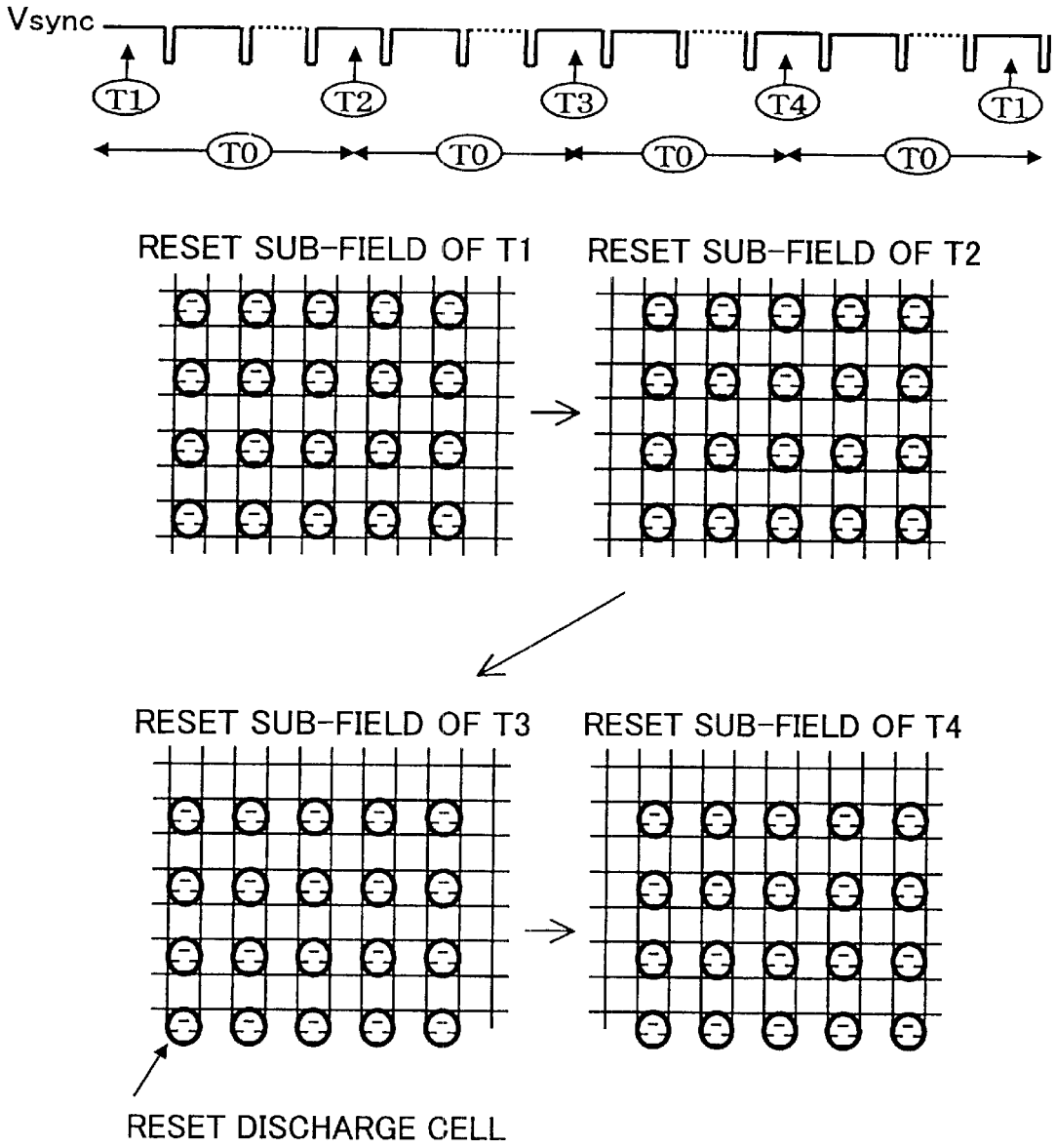
FIG. 22 is a drawing for explaining another embodiment for performing periodic compulsory reset discharge.

FIG. 22 is a drawing for explaining another embodiment for performing periodic compulsory reset discharge.

FIG. 22 shows a scheme similar to that of FIG. 21, but the cells are divided into four groups as they are subjected to periodic compulsory reset discharge. Reset discharge is performed piece by piece at T1 through T4 where the interval of reset discharge is T0. The interval T0 is set equal to 0.016 second, which does not generate any flicker when the entirety of the screen is taken into account. Since the reset discharge generates only a miniscule intensity of light, the interval may be set to a few-second interval without creating disturbing visual effect.

Figure 23:
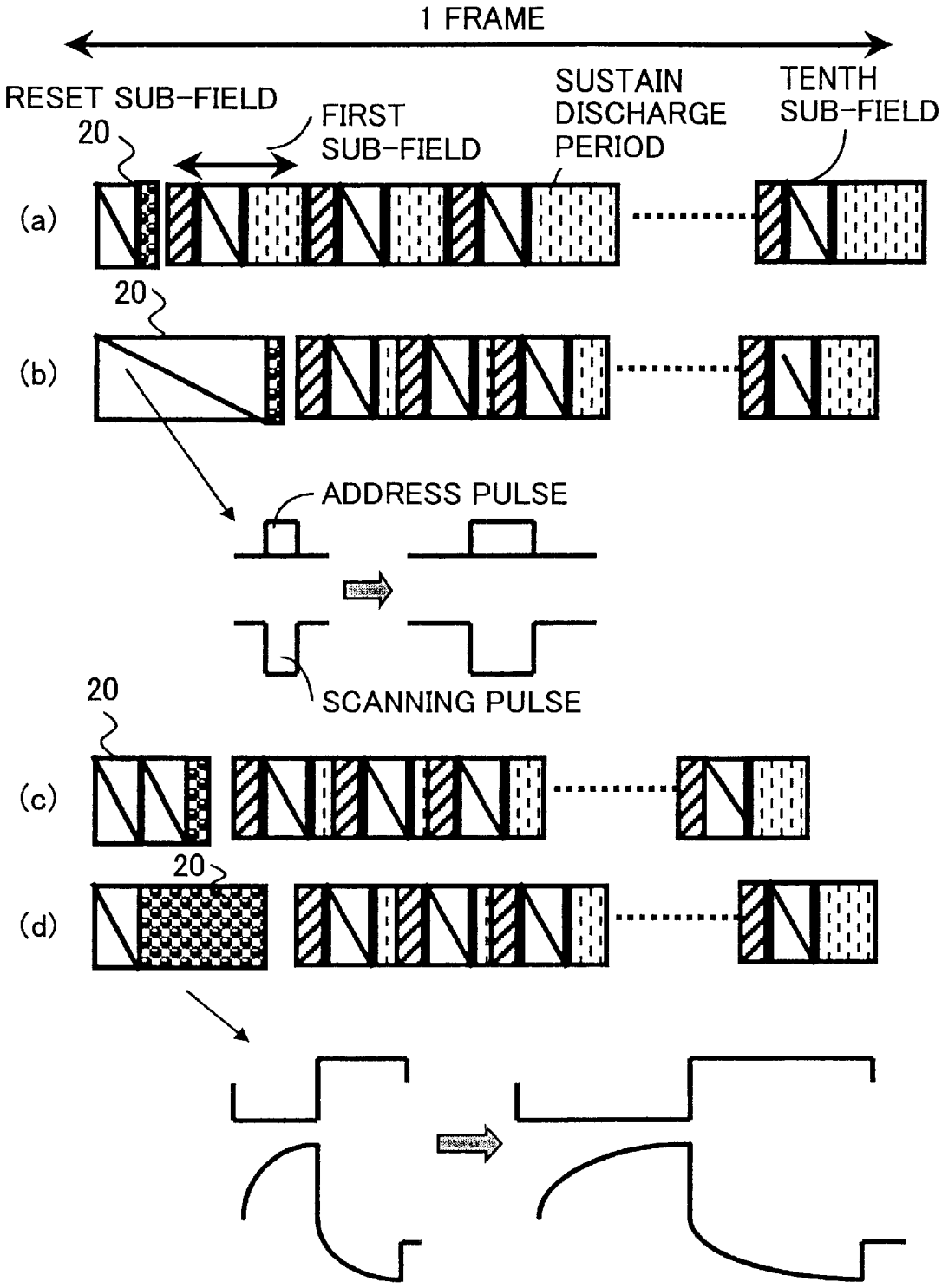
FIG. 23 is a drawing for explaining an embodiment in which a time spared by the shortening of sustain discharge periods in display-purpose sub-fields is utilized as part of a reset sub-field.

FIG. 23 is a drawing for explaining an embodiment in which a time spared by the shortening of sustain discharge periods in the display-purpose sub-fields is utilized as part of a reset sub-field.

When the brightness of the entire screen is lowered or when the number of repeated light emissions is limited so as to suppress electric power consumption in response to a rise in the display rate, the sustain discharge period is shortened in the display-purpose sub-fields. A time spared by this may be allocated to the reset sub-field, thereby achieving a stable reset discharge.

In FIG. 23, (a), a reference case is shown in which the number of repeated light emissions for sustain discharge is set maximum in the display-purpose sub-fields. In FIG. 23, (b) and (c), a case is shown in which the reset sub-field is extended according to the present invention. A function to limit the number of repeated light emissions is activated to shorten the time length of the first sub-field through the tenth sub-field, and a spared time is utilized to elongate the reset sub-field.

In FIG. 23, (b), the spared time is utilized to elongate the width of the reset scanning pulses of the reset sub-field. This achieves the reliable generation of reset scanning discharges even under the conditions of a very weak seeds effect.

In FIG. 23, (c), the spared time is utilized to perform the reset scanning operation twice in a row. Even when an attempt to generate a discharge fails first time, the second discharge can be generated, thereby achieving the reliable generation of reset scanning discharge.

In FIG. 23, (d), the spared time is utilized to extend the time period of erase discharge that follows the reset scanning discharge. When an erase pulse having a gentle slope as shown in FIG. 19 is used, the gentler the slope, the smaller the amount of light emission is. As the amount of light emission decreases, an effect on the quality of gray-scale representation will be decreased. Some or all of the schemes shown in (b), (c), and (d) may be combined together.

Figure 24:
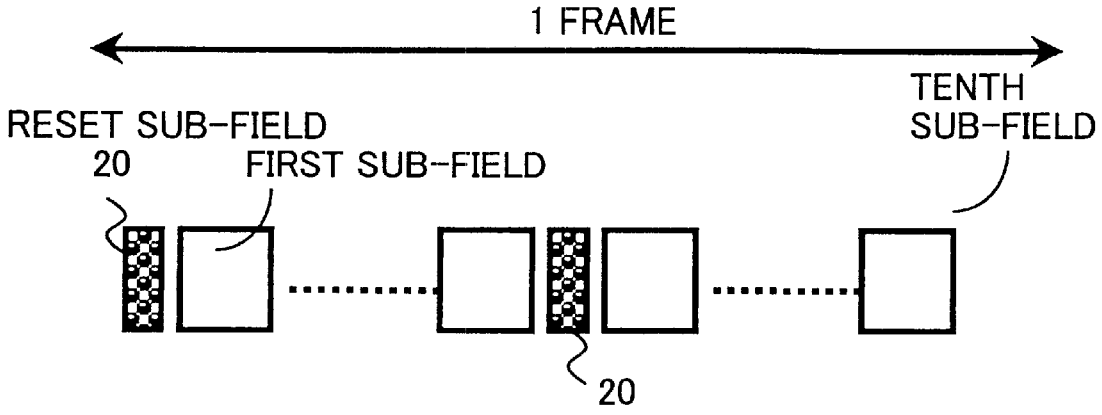
FIG. 24 is a drawing showing an embodiment in which two reset sub-fields are provided in one frame.

FIG. 24 is a drawing showing an embodiment in which two reset sub-fields are provided in one frame.

As shown in FIG. 24, a reset sub-field may be performed twice in each frame, thereby attaining an efficient seeds effect.

Figure 25:
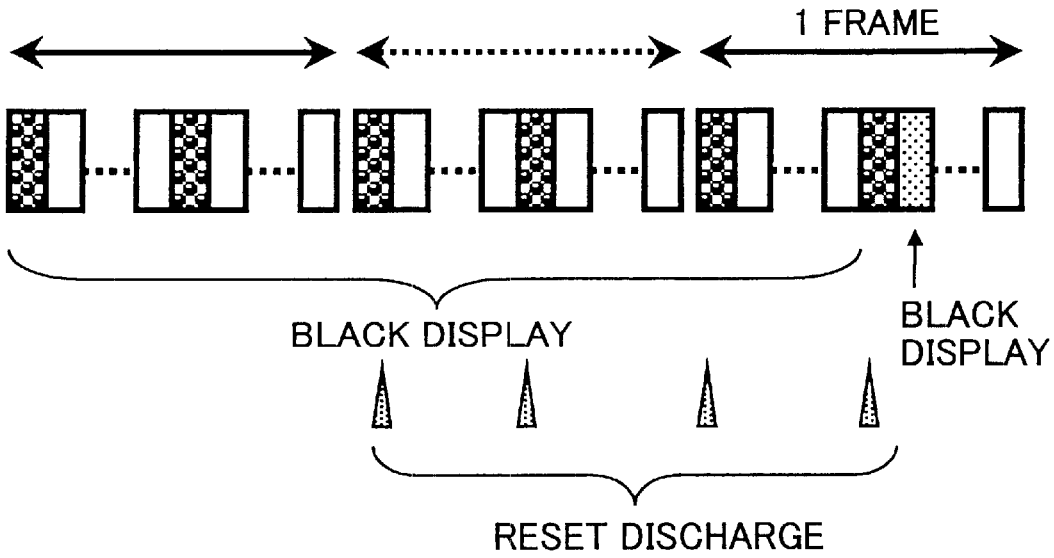
FIG. 25 is a drawing showing an embodiment in which reset discharge is performed multiple times by starting several reset periods before the actual emitting of light.

FIG. 25 is a drawing showing an embodiment in which reset discharge is performed multiple times by starting several reset periods before the actual emitting of light.

As shown in FIG. 25, a series of reset discharges is started several reset periods before the emitting of light. Even if the first attempt for discharge fails, the second attempt may succeed in igniting a discharge. Even if the second attempt fails, the third attempt may succeed. In this manner, as a reset discharge is attempted multiple times, it is likely to have a successful discharge after several attempt. The larger the number of attempts, the higher the probability of successful discharge is. The configuration that performs reset discharge multiple times thus achieves reliable reset discharge.

Further, the present invention is not limited to these embodiments, but various variations and modifications may be made without departing from the scope of the present invention.

The present application is based on Japanese priority application No. 2000-261605 filed on Aug. 30, 2000, with the Japanese Patent Office, the entire contents of which are hereby incorporated by reference.

What is claimed is:

1. A method of driving a plasma display panel, comprising the steps of:

detecting, with respect to each cell, whether display data is present;

avoiding reset discharge with respect to a cell that is to display a black level because of absence of the display data; and generating reset discharge prior to displaying of the display data with respect to a cell that is to display a non-black level because of presence of the display data.

2. The method as claimed in claim 1, wherein a reset sub-field including a reset scanning period and a reset discharge period is provided prior to the displaying of the display data, and said step of generating reset discharge includes the steps of:

generating reset scanning discharge between scanning electrodes and address electrodes in the reset scanning period according to determination of whether display data is present; and generating the reset discharge, in the reset discharge period, with respect to cells for which the reset scanning discharge was generated.

3. The method as claimed in claim 2, wherein a voltage applied to the scanning electrodes during the reset scanning period is higher than a voltage that is applied to the scanning electrodes during address discharge for displaying the display data.

4. The method as claimed in claim 2, wherein a pulse applied to the scanning electrodes during the reset scanning period is wider in a time dimension than a pulse that is applied to the scanning electrodes during address discharge for displaying the display data.

5. The method as claimed in claim 2, wherein a voltage is simultaneously applied to a plurality of lines of the scanning electrodes during the reset scanning period so as to generate the reset scanning discharge concurrently at the plurality of lines.

6. The method as claimed in claim 1, further comprising a step of periodically generating reset discharge with respect to cells that display the black level continuously for more than a predetermined time period.

7. The method as claimed in claim 1, further comprising a step of setting a period for the reset discharge in response to a period for displaying of the display data.

8. The method as claimed in claim 1, wherein the reset discharge is performed multiple times in one of a frame and a field.

9. The method as claimed in claim 1, wherein said step of generating reset discharge includes performing the reset discharge multiple times prior to the displaying of the display data with respect to a cell for which the display data exists.

10. The method as claimed in claim 2, wherein one frame includes the reset sub-field and a plurality of sub-fields for displaying the display data, and said step of generating the reset discharge generates the reset discharge in the reset sub-field with respect to a cell for which the display data exists in at least one of the plurality of sub-fields.

11. A plasma display apparatus, comprising:

a data detection circuit which detects, with respect to each cell, whether display data is present; and a driving circuitry which avoids reset discharge with respect to a cell that is to display a black level because of absence of the display data, and generates reset discharge prior to displaying of the display data with respect to a cell that is to display a non-black level because of presence of the display data.

* * * * *